US010852671B2

(12) United States Patent
Imada et al.

(10) Patent No.: US 10,852,671 B2
(45) Date of Patent: Dec. 1, 2020

(54) FIXING DEVICE INCLUDING A CLEANER TO CLEAN A SURFACE OF A CLEANING TARGET AND IMAGE FORMING APPARATUS INCORPORATING SAME

(71) Applicants: Takahiro Imada, Kanagawa (JP); Yoshio Hattori, Kanagawa (JP); Yoshikuni Sasaki, Kanagawa (JP); Hironori Yamaoka, Tochigi (JP); Yasunori Ishigaya, Kanagawa (JP); Takumi Waida, Kanagawa (JP)

(72) Inventors: Takahiro Imada, Kanagawa (JP); Yoshio Hattori, Kanagawa (JP); Yoshikuni Sasaki, Kanagawa (JP); Hironori Yamaoka, Tochigi (JP); Yasunori Ishigaya, Kanagawa (JP); Takumi Waida, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/675,912

(22) Filed: Nov. 6, 2019

(65) Prior Publication Data

US 2020/0159148 A1 May 21, 2020

(30) Foreign Application Priority Data

Nov. 15, 2018 (JP) ..... 2018-214955

(51) Int. Cl.
*G03G 15/20* (2006.01)

(52) U.S. Cl.
CPC ..... *G03G 15/2025* (2013.01)

(58) Field of Classification Search
CPC ..... G03G 15/2025
(Continued)

(56) References Cited

U.S. PATENT DOCUMENTS 6,243,558 B1 * 6/2001 Oota ..... G03G 15/2025 15/256.51
8,170,435 B2 * 5/2012 Ueno ..... G03G 15/2064 399/67

(Continued)

FOREIGN PATENT DOCUMENTS

JP 58100874 A * 6/1983 ..... G03G 15/2025
JP 03282578 A * 12/1991

(Continued)

*Primary Examiner* — Robert B Beatty
(74) *Attorney, Agent, or Firm* — Harness, Dickey and Pierce, P.L.C.

(57) ABSTRACT

A fixing device includes a fixing rotator, a pressure rotator, a cleaner, and a moving assembly. The cleaner contacts and cleans a cleaning target, which includes one of the fixing rotator and the pressure rotator. The moving assembly moves the cleaner between a contact position at which the cleaner contacts the cleaning target and a separate position at which the cleaner is apart from the cleaning target. The moving assembly includes a biasing member that presses the cleaner to move to the contact position. The moving assembly moves the cleaner from the contact position to the separate position against a biasing force of the biasing member. The moving assembly moves the cleaner from the separate position to the contact position while increasing and then decreasing the biasing force of the biasing member greater than the biasing force applied when the cleaner is located at the contact position.

19 Claims, 11 Drawing Sheets

(58) Field of Classification Search
USPC ..... 399/326, 327
See application file for complete search history.

(56) References Cited

U.S. PATENT DOCUMENTS

| | | | | |
|---|---|---|---|---|
| 9,367,030 | B2 * | 6/2016 | Lee | G03G 15/161 |
| 9,785,101 | B2 * | 10/2017 | Ujiie | G03G 15/2053 |
| 2010/0310288 | A1 * | 12/2010 | Takagi | G03G 15/2025 399/327 |
| 2013/0011172 | A1 * | 1/2013 | Ogawahara | G03G 15/2025 399/327 |
| 2016/0306311 | A1 | 10/2016 | Ono et al. | |
| 2017/0146933 | A1 | 5/2017 | Yamano et al. | |
| 2017/0343942 | A1 | 11/2017 | Okamoto et al. | |
| 2018/0224779 | A1 | 8/2018 | Tomita et al. | |
| 2018/0329342 | A1 | 11/2018 | Seshita et al. | |

FOREIGN PATENT DOCUMENTS

| | | | | |
|---|---|---|---|---|
| JP | 7-230229 | | 8/1995 | |
| JP | 11-242402 | | 9/1999 | |
| JP | 2005077700 | A * | 3/2005 | |
| JP | 2006053176 | A * | 2/2006 | G03G 15/2025 |
| JP | 2006-162996 | | 6/2006 | |
| JP | 2007304180 | A * | 11/2007 | |
| JP | 2018-123951 | | 8/2018 | |

* cited by examiner

FIXING DEVICE INCLUDING A CLEANER TO CLEAN A SURFACE OF A CLEANING TARGET AND IMAGE FORMING APPARATUS INCORPORATING SAME

CROSS-REFERENCE TO RELATED APPLICATION

This patent application is based on and claims priority pursuant to 35 U.S.C. § 119(a) to Japanese Patent Application No. 2018-214955, filed on Nov. 15, 2018, in the Japan Patent Office, the entire disclosure of which is hereby incorporated by reference herein.

BACKGROUND

Technical Field

Embodiments of the present disclosure generally relate to a fixing device and an image forming apparatus incorporating the fixing device, and more particularly, to a fixing device for fixing a toner image onto a recording medium, and an image forming apparatus for forming an image on a recording medium with the fixing device.

Related Art

Various types of electrophotographic image forming apparatuses are known, including copiers, printers, facsimile machines, and multifunction machines having two or more of copying, printing, scanning, facsimile, plotter, and other capabilities. Such image forming apparatuses usually form an image on a recording medium according to image data. Specifically, in such image forming apparatuses, for example, a charger uniformly charges a surface of a photoconductor as an image bearer. An optical writer irradiates the surface of the photoconductor thus charged with a light beam to form an electrostatic latent image on the surface of the photoconductor according to the image data. A developing device supplies toner to the electrostatic latent image thus formed to render the electrostatic latent image visible as a toner image. The toner image is then transferred onto a recording medium either directly, or indirectly via an intermediate transfer belt. Finally, a fixing device applies heat and pressure to the recording medium bearing the toner image to fix the toner image onto the recording medium. Thus, an image is formed on the recording medium.

Such a fixing device typically includes a fixing rotator, such as a roller, a belt, and a film, and a pressure rotator, such as a roller and a belt, pressed against the fixing rotator. The fixing rotator and the pressure rotator apply heat and pressure to the recording medium, melting and fixing the toner image onto the recording medium while the recording medium is conveyed between the fixing rotator and the pressure rotator. The fixing device may also include a cleaner that contacts and cleans a surface of the fixing rotator or the pressure rotator.

SUMMARY

In one embodiment of the present disclosure, a novel fixing device includes a fixing rotator, a pressure rotator, a cleaner, and a moving assembly. The fixing rotator is configured to heat a toner image and fix the toner image onto a surface of a recording medium. The pressure rotator is configured to press against the fixing rotator to form a fixing nip through which the recording medium is conveyed between the fixing rotator and the pressure rotator. The cleaner is configured to contact and clean a surface of a cleaning target. The cleaning target includes one of the fixing rotator and the pressure rotator. The moving assembly is configured to move the cleaner between a contact position at which the cleaner contacts the surface of the cleaning target and a separate position at which the cleaner is apart from the surface of the cleaning target. The moving assembly includes a biasing member that is configured to press the cleaner to move to the contact position. The moving assembly is configured to move the cleaner from the contact position to the separate position against a biasing force of the biasing member. The moving assembly is configured to move the cleaner from the separate position to the contact position while increasing the biasing force of the biasing member greater than the biasing force applied when the cleaner is located at the contact position and then decreasing the increased biasing force of the biasing member.

Also described is a novel image forming apparatus incorporating the fixing device.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

The accompanying drawings are intended to depict embodiments of the present disclosure and should not be interpreted to limit the scope thereof. Also, identical or similar reference numerals designate identical or similar components throughout the several views.

DETAILED DESCRIPTION

Figure 1:
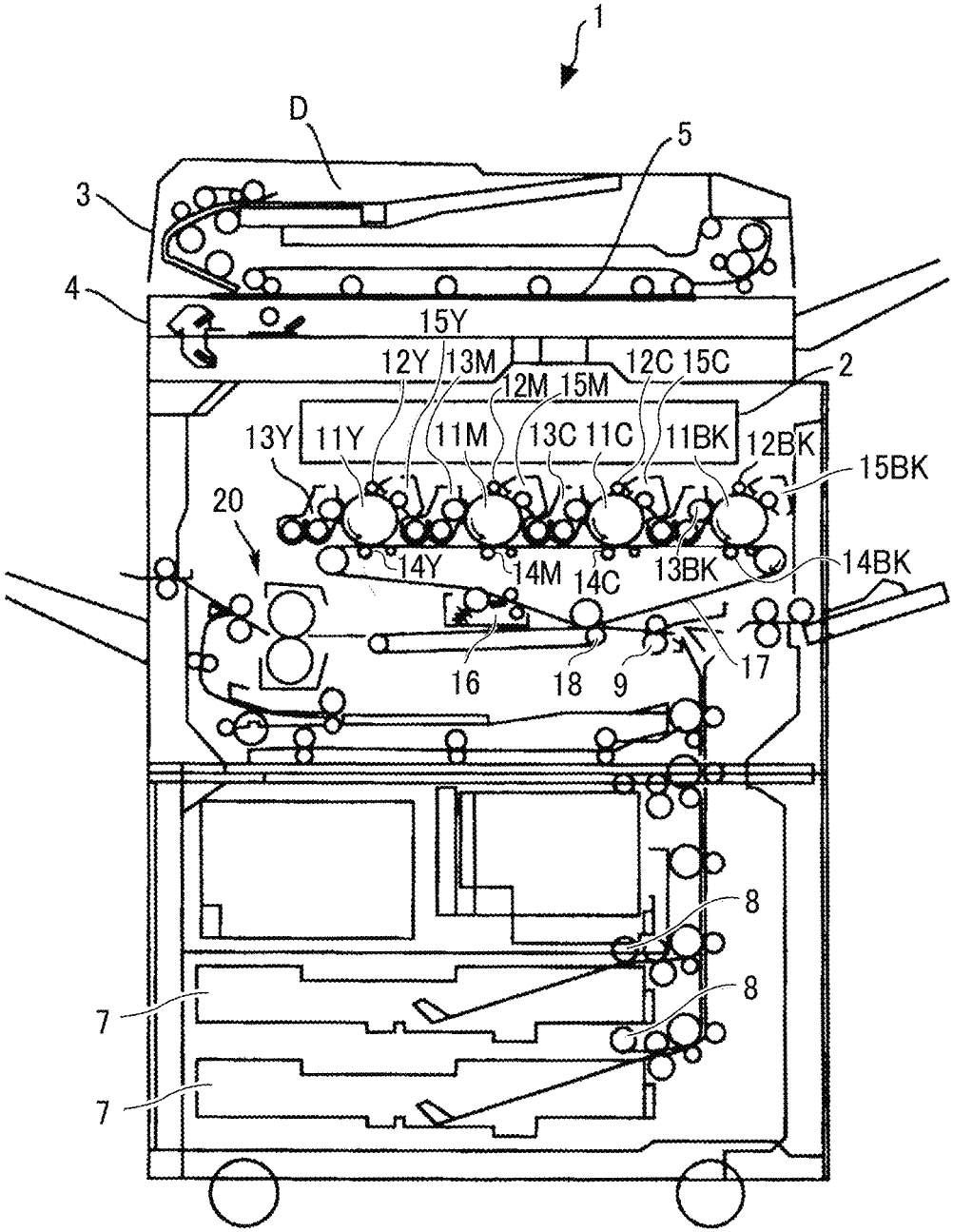
FIG. 1 is a schematic view of an image forming apparatus according to an embodiment of the present disclosure.

In describing embodiments illustrated in the drawings, specific terminology is employed for the sake of clarity. However, the disclosure of the present specification is not intended to be limited to the specific terminology so selected and it is to be understood that each specific element includes all technical equivalents that have a similar function, operate in a similar manner, and achieve a similar result.

Although the embodiments are described with technical limitations with reference to the attached drawings, such description is not intended to limit the scope of the disclosure and not all of the components or elements described in the embodiments of the present disclosure are indispensable to the present disclosure.

In a later-described comparative example, embodiment, and exemplary variation, for the sake of simplicity like reference numerals are given to identical or corresponding constituent elements such as parts and materials having the same functions, and redundant descriptions thereof are omitted unless otherwise required.

As used herein, the singular forms "a", "an", and "the" are intended to include the plural forms as well, unless the context clearly indicates otherwise.

It is to be noted that, in the following description, suffixes Y, M, C, and BK denote colors of yellow, magenta, cyan, and black, respectively. To simplify the description, these suffixes are omitted unless necessary.

Referring to the drawings, wherein like reference numerals designate identical or corresponding parts throughout the several views, embodiments of the present disclosure are described below.

Initially with reference to FIG. 1, a description is given of overall configuration and operation of an image forming apparatus 1 according to an embodiment of the present disclosure.

FIG. 1 is a schematic view of the image forming apparatus 1.

The image forming apparatus 1 may be, e.g., a copier, a facsimile machine, a printer, or a multifunction peripheral (MFP) having at least two of copying, printing, scanning, facsimile, and plotter functions.

FIG. 1 illustrates the image forming apparatus 1 as a color copier that employs a tandem structure and forms color and monochrome images on recording media by electrophotography. The image forming apparatus includes, e.g., a writer 2, a document feeder 3, and a scanner 4. The writer 2 emits laser light according to input image data. The document feeder 3 feeds or conveys a document D to the scanner 4. The scanner 4 reads image data of the document D.

The image forming apparatus 1 further includes a sheet feeder 7 (in this case, a plurality of sheet feeders 7), a registration roller pair 9 (also referred to as a timing roller pair), and four drum-shaped photoconductors 11Y, 11M, 11C, and 11BK. The sheet feeder 7 accommodates one or more sheets P such as paper sheets. The registration roller pair 9 adjusts a conveyance timing of the sheet P. The photoconductors 11Y, 11M, 11C, and 11BK bear toner images of yellow, magenta, cyan, and black, respectively.

Each of the photoconductors 11Y, 11M, 11C, and 11BK is surrounded by various pieces of equipment. For example, the photoconductor 11Y is surrounded by a charger 12Y, a developing device 13Y, a primary-transfer bias roller 14Y, and a cleaner 15Y. Like the photoconductor 11Y, the photoconductors 11M, 11C, and 11BK are surrounded by chargers 12M, 12C, and 12BK, developing devices 13M, 13C, and 13BK, primary-transfer bias rollers 14M, 14C, and 14BK, and cleaners 15M, 15C, and 15BK, respectively. The chargers 12Y, 12M, 12C, and 12BK charge the surface of the photoconductors 11Y, 11M, 11C, and 11BK, respectively. The developing devices 13Y, 13M, 13C, and 13BK develop, as visible toner images, electrostatic latent images formed on the surface of the photoconductors 11Y, 11M, 11C, and 11BK, respectively. The primary-transfer bias rollers 14Y, 14M, 14C, and 14BK transfer the toner images from the surface of the photoconductors 11Y, 11M, 11C, and 11BK, respectively, onto an outer circumferential surface of an intermediate transfer belt 17 such that the toner images are superimposed one atop another on the intermediate transfer belt 17. The cleaners 15Y, 15M, 15C, and 15BK remove and collect residual toner from the surface of the photoconductors 11Y, 11M, 11C, and 11BK, respectively. The residual toner refers to toner that has failed to be transferred onto the intermediate transfer belt 17 and therefore remains on the surface of the respective photoconductors 11Y, 11M, 11C, and 11BK.

The image forming apparatus 1 further includes an intermediate transfer belt cleaner 16, the intermediate transfer belt 17, a secondary-transfer bias roller 18, and a fixing device 20. The intermediate transfer belt cleaner 16 cleans the intermediate transfer belt 17. The intermediate transfer belt 17 bears different colors of toner images superimposed one atop another. The secondary-transfer bias roller 18 transfers the toner images from the intermediate transfer belt 17 onto the sheet P as a composite color toner image. The fixing device 20 fixes the unfixed color toner image onto the sheet P.

To provide a fuller understanding of the embodiments of the present disclosure, a description is now given of a general image forming operation of the image forming apparatus 1 to form or print a color image, with continued reference to FIG. 1.

The document feeder 3 conveys, with conveyance rollers, the document D from a document tray onto an exposure glass 5 (also referred to as a platen) of the scanner 4. Thus, the document D is loaded on the exposure glass 5. The scanner 4 optically reads the image data of the document D loaded on the exposure glass 5.

Specifically, the scanner 4 irradiates an image of the document D on the exposure glass 5 with light emitted from a light source (e.g., a lamp), thereby scanning the image of the document D. The light reflected by the document D is reflected by a plurality of mirrors, travels through a lens, and enters a color sensor that forms an image. The color sensor reads the image data (or color image data) of the document D into color separation light in red (R), green (G), and blue (B) and converts the light into electric signals. An image processor of the scanner 4 performs a plurality of processes, such as color conversion, color correction, and spatial frequency correction, based on the electric signals (specifically, RGB color separation image signals). As a consequence, the scanner 4 obtains color image data of yellow, magenta, cyan, and black.

The image data of yellow, magenta, cyan, and black is sent to the writer 2. The writer 2 emits laser light or beams (e.g., exposure light) onto the surface of the photoconductors 11Y, 11M, 11C, and 11BK according to the image data of yellow, magenta, cyan, and black, respectively.

Each of the four photoconductors 11Y, 11M, 11C, and 11BK rotates counterclockwise in FIG. 1. The chargers 12Y, 12M, 12C, and 12BK disposed opposite the photoconductors 11Y, 11M, 11C, and 11BK uniformly charge the surface of the photoconductors 11Y, 11M, 11C, and 11BK, respectively, in a charging process. Thus, a charging potential is produced on the surface of each of the photoconductors 11Y, 11M, 11C, and 11BK.

Thereafter, the charged surface of the respective photoconductors 11Y, 11M, 11C, and 11BK reaches an irradiation position to be irradiated with a laser beam from the writer 2. Specifically, four light sources of the writer 2 emit laser beams corresponding to the image data of yellow, magenta, cyan, and black onto the photoconductors 11Y, 11M, 11C, and 11BK through separate optical paths, respectively, in an exposure process.

For example, the surface of the leftmost photoconductor 11Y in FIG. 1 is irradiated with a laser beam corresponding to the image data of yellow. A polygon mirror rotated at high speed directs the laser beam corresponding to the image data of yellow in an axial direction of the photoconductor 11Y, that is, a main scanning direction. The axial direction of the photoconductors 11Y, 11M, 11C, and 11BK may be hereinafter referred to as a width direction. Thus, an electrostatic latent image corresponding to the image data of yellow is formed on the photoconductor 11Y charged by the charger 12Y.

Similarly, the surface of the second photoconductor 11M from left in FIG. 1 is irradiated with a laser beam corresponding to the image data of magenta. Thus, an electrostatic latent image corresponding to the image data of magenta is formed on the photoconductor 11M. The surface of the third photoconductor 11C from left in FIG. 1 is irradiated with a laser beam corresponding to the image data of cyan. Thus, an electrostatic latent image corresponding to the image data of cyan is formed on the photoconductor 11C. The surface of the fourth photoconductor 11BK from left in FIG. 1 is irradiated with a laser beam corresponding to the image data of black. Thus, an electrostatic latent image corresponding to the image data of black is formed on the photoconductor 11BK.

Thereafter, the surface of the respective photoconductors 11Y, 11M, 11C, and 11BK bearing the electrostatic latent image reaches a developing position opposite the respective developing devices 13Y, 13M, 13C, and 13BK. The developing devices 13Y, 13M, 13C, and 13BK supply toner of yellow, magenta, cyan, and black to the photoconductors 11Y, 11M, 11C, and 11BK, developing the electrostatic latent images formed on the photoconductors 11Y, 11M, 11C, and 11BK into toner images of yellow, magenta, cyan, and black, respectively, in a developing process.

The toner images thus formed on the photoconductors 11Y, 11M, 11C, and 11BK, respectively, reach primary transfer positions opposite the intermediate transfer belt 17. The primary-transfer bias rollers 14Y, 14M, 14C, and 14BK are disposed opposite the photoconductors 11Y, 11M, 11C, and 11BK via the intermediate transfer belt 17 at the primary transfer positions. Specifically, the primary-transfer bias rollers 14Y, 14M, 14C, and 14BK contact an inner circumferential surface of the intermediate transfer belt 17 to form four areas of contact, herein called primary transfer nips, between the intermediate transfer belt 17 and the photoconductors 11Y, 11M, 11C, and 11BK, respectively. At the primary transfer nips, the toner images of yellow, magenta, cyan, and black formed on the respective photoconductors 11Y, 11M, 11C, and 11BK are transferred onto the intermediate transfer belt 17 successively such that the toner images of yellow, magenta, cyan, and black are superimposed one atop another on the intermediate transfer belt 17 in a primary transfer process.

After the primary transfer process, the surface of the respective photoconductors 11Y, 11M, 11C, and 11BK reaches a cleaning position opposite the respective cleaners 15Y, 15M, 15C, and 15BK. The cleaners 15Y, 15M, 15C, and 15BK remove and collect the residual toner from the surface of the photoconductors 11Y, 11M, 11C, and 11BK, respectively, in a cleaning process. As described above, the residual toner is toner that has failed to be transferred onto the intermediate transfer belt 17 and therefore remains on the surface of the respective photoconductors 11Y, 11M, 11C, and 11BK.

Thereafter, a discharger discharges the surface of the respective photoconductors 11Y, 11M, 11C, and 11BK, thus completing a series of image forming processes performed on the photoconductors 11Y, 11M, 11C, and 11BK.

On the other hand, as the intermediate transfer belt 17 rotates clockwise in FIG. 1, the toner images of yellow, magenta, cyan, and black superimposed one atop another on the intermediate transfer belt 17 reach a secondary transfer position at which the intermediate transfer belt 17 faces the secondary-transfer bias roller 18 and forms an area of contact, herein called a secondary transfer nip, between the intermediate transfer belt 17 and the secondary-transfer bias roller 18. At the secondary transfer nip, the secondary-transfer bias roller 18 transfers the toner images of yellow, magenta, cyan, and black from the intermediate transfer belt 17 onto a sheet P as a composite color toner image in a secondary transfer process.

Thereafter, the outer circumferential surface of the intermediate transfer belt 17 reaches a cleaning position opposite the intermediate transfer belt cleaner 16. The intermediate transfer belt cleaner 16 removes and collects residual toner from the intermediate transfer belt 17, thus completing a series of transfer processes performed on the intermediate transfer belt 17. Note that the residual toner is herein toner that has failed to be transferred onto the sheet P and therefore remains on the intermediate transfer belt 17.

The sheet P is conveyed from the sheet feeder 7 via, e.g., the registration roller pair 9 to the secondary transfer nip between the intermediate transfer belt 17 and the secondary-transfer bias roller 18. At the secondary transfer nip, the color toner image is formed on the sheet P thus conveyed.

Specifically, one of a plurality of sheet feeding rollers 8 picks up and feeds the sheet P from the corresponding sheet feeder 7 that accommodates a plurality of sheets P. The sheet P is conveyed along a conveyance passage, defined by internal components of the image forming apparatus 1, toward the registration roller pair 9. After the sheet P reaches the registration roller pair 9, activation of the registration roller pair 9 is timed to send out the sheet P toward the secondary transfer nip such that the sheet P meets the toner images of yellow, magenta, cyan, and black on the intermediate transfer belt 17 at the secondary transfer nip.

A conveyance belt conveys the sheet P bearing the color toner image toward the fixing device 20. The fixing device 20 fixes the color toner image onto a surface of the sheet P at an area of contact, herein called a fixing nip, between a fixing roller and a pressure roller in a fixing process.

After the fixing process, a sheet ejection roller pair ejects the sheet P bearing the fixed color toner image as an output image toward an outside of the image forming apparatus 1, thus completing a series of image forming processes as a print operation.

Referring now to FIGS. 2 to 10, a description is given of a configuration and operation of the fixing device 20 incorporated in the image forming apparatus 1 described above.

Figure 2:
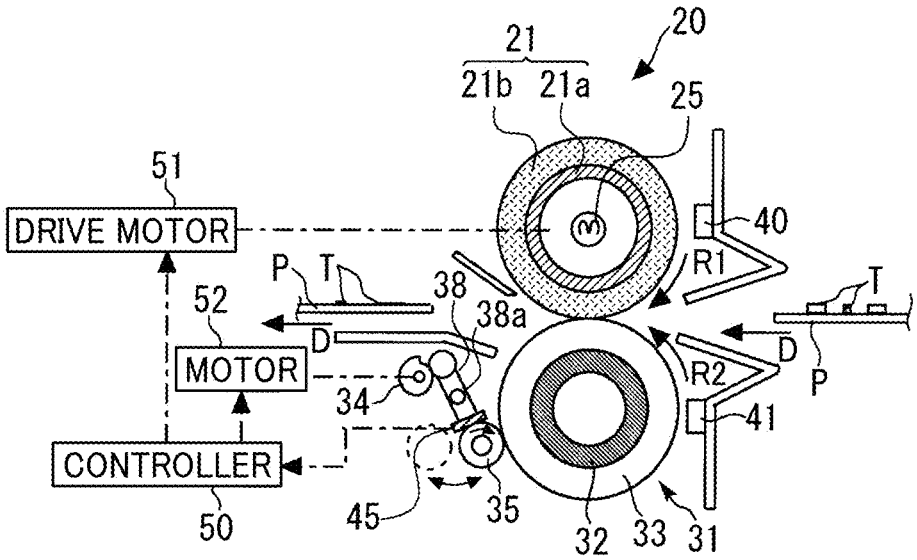
FIG. 2 is a diagram illustrating a configuration of a fixing device incorporated in the image forming apparatus of FIG. 1.

Initially with reference to FIG. 2, a description is given of a configuration of the fixing device 20.

FIG. 2 is a diagram illustrating the configuration of the fixing device 20.

As illustrated in FIG. 2, the fixing device 20 includes a fixing roller 21 serving as a fixing rotator, a heater 25, a pressure roller 31 serving as a pressure rotator, a cleaning roller 35 serving as a cleaner, temperature sensors 40, 41, and 45 serving as temperature detectors, and a moving assembly 80. The moving assembly 80 is constructed of a cam 34, an arm 38, and a torsion spring 39.

The fixing roller 21 (i.e., fixing rotator) is a multi-layer roller constructed of a core 21*a*, an elastic layer 21*b* resting on the core 21*a*, and a release layer resting on the elastic layer 21*b* as a surface layer. The core 21*a* is a hollow core made of a metal material such as stainless steel. The fixing roller 21 presses against the pressure roller 31 (i.e., pressure rotator) thereby forming a fixing nip between the fixing roller 21 and the pressure roller 31.

The elastic layer 21*b* of the fixing roller 21 is made of an elastic material such as fluoro rubber, silicon rubber, or silicon rubber foam. The release layer of the fixing roller 21 is made of tetrafluoroethylene-perfluoroalkylvinylether copolymer (PFA) or the like. The release layer, serving as a surface layer of the fixing roller 21, facilitates separation or peeling-off of toner T contained in a toner image from the fixing roller 21. A drive motor 51 drives and rotates the fixing roller 21 in a clockwise direction of rotation R1 in FIG. 2.

The heater 25 is a heat source secured inside the hollow core 21*a* of the fixing roller 21 to heat the fixing roller 21.

The heater 25 is herein a halogen heater. Opposed longitudinal ends of the heater 25 are secured to side plates of the fixing device 20, respectively. When the image forming apparatus 1 is powered on, a power supply supplies power to the heater 25. A controller 50 causes the heater 25 to output radiation heat to heat the fixing roller 21. The heat is conducted from an outer circumferential surface of the fixing roller 21, which is heated by the heater 25, to the toner image containing the toner T on the sheet P.

The controller 50 controls the output of the heater 25 based on a surface temperature of the fixing roller 21 (specifically, a temperature of the outer circumferential surface of the fixing roller 21) detected by the temperature sensor 40. The temperature sensor 40 is disposed opposite the outer circumferential surface of the fixing roller 21 without contacting the outer circumferential surface of the fixing roller 21. Specifically, an alternating current (AC) voltage is applied to the heater 25 for an energization time determined based on the temperature detected by the temperature sensor 40 (e.g., thermopile). With such output control of the heater 25, the temperature of the fixing roller 21 (or fixing temperature) is adjusted to a desired temperature (or a target control temperature).

The pressure roller 31 (i.e., pressure rotator) is mainly constructed of a core 32 and an elastic layer 33 resting an outer circumferential surface of the core 32 via an adhesion layer. The elastic layer 33 of the pressure roller 31 is made of a material such as silicon rubber foam, fluoro rubber, or silicon rubber. Optionally, a thin release layer made of PFA or the like may rest on an outer circumferential surface of the elastic layer 33.

A pressure device presses the pressure roller 31 against the fixing roller 21, thus forming a desired fixing nip between the pressure roller 31 and the fixing roller 21.

The pressure roller 31 is rotated in a counterclockwise direction of rotation R2 in FIG. 2 by the fixing roller 21 that rotates in the clockwise direction of rotation R1 in FIG. 2.

As described above, the fixing device 20 of the present embodiment includes the moving assembly 80, the cleaning roller 35, and the temperature sensor 45. The moving assembly 80, constructed of the cam 34, the arm 38, and the torsion spring 39, causes the cleaning roller 35 to contact the pressure roller 31 and separates the cleaning roller 35 from the pressure roller 31. The cleaning roller 35 (i.e., cleaner) removes extraneous matter such as toner and paper dust adhering to a surface of the pressure roller 31, thus cleaning the surface of the pressure roller 31. That is, the pressure roller 31 is herein a cleaning target for the cleaning roller 35. The temperature sensor 45 (i.e., temperature detector) detects a temperature of the cleaning roller 35. A detailed description of the moving assembly 80, the cleaning roller 35, and the temperature sensor 45 is deferred.

With continued reference to FIG. 2, a description is now given of operation of the fixing device 20 configured as described above.

When the image forming apparatus 1 is powered on, the heater 25 is supplied with power. In other words, the AC voltage is applied to the heater 25.

In response to a print command or print request, the drive motor 51, serving as a driving device, starts rotating the fixing roller 21 clockwise in FIG. 2. Meanwhile, the pressure roller 31 starts rotating counterclockwise in FIG. 2 in accordance with the clockwise rotation of the fixing roller 21. Then, at the secondary transfer nip between the intermediate transfer belt 17 and the secondary-transfer bias roller 18, a toner image is transferred from the intermediate transfer belt 17 onto a sheet P fed from the sheet feeder 7.

Thus, the sheet P bears the toner image as an unfixed toner image. As illustrated in FIG. 2, the sheet P bearing the unfixed toner image (i.e., toner image containing the toner T) is conveyed in a direction D (hereinafter referred to as a sheet conveyance direction D) and enters the fixing nip between the fixing roller 21 and the pressure roller 31 pressed against the fixing roller 21. At the fixing nip, the toner image containing the toner T is fixed onto a surface of the sheet P under heat from the fixing roller 21 and pressure exerted from the fixing roller 21 and the pressure roller 31. Thus, the sheet P bears the toner image as a fixed toner image. Then, the sheet P bearing the fixed toner image is sent out of the fixing nip in the sheet conveyance direction D by the fixing roller 21 and the pressure roller 31 as the fixing roller 21 and the pressure roller 31 rotate.

Figure 3:
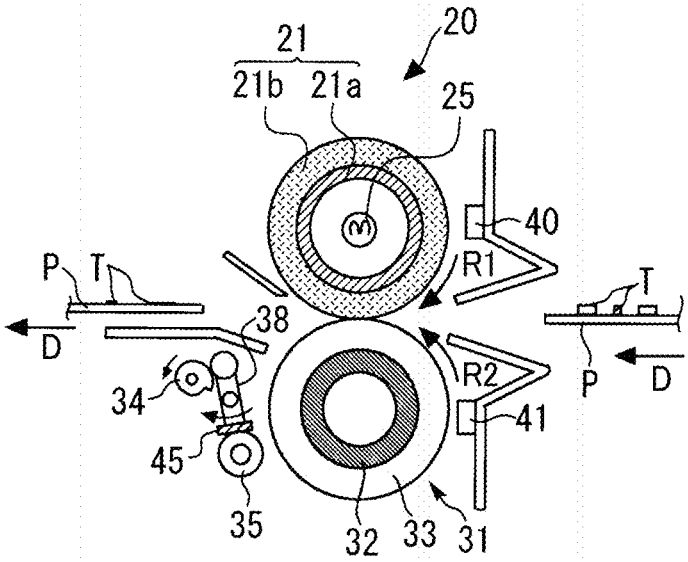
FIG. 3 is a cross-sectional view of the fixing device, illustrating a cleaning roller apart from a pressure roller.

With reference to FIGS. 2 and 3, a detailed description is now given of the configuration and operation of the fixing device 20 in the image forming apparatus 1.

FIG. 3 is a cross-sectional view of the fixing device 20, illustrating the cleaning roller 35 apart from the pressure roller 31.

As described above with reference to FIG. 2, the fixing device 20 includes the fixing roller 21 (i.e., fixing rotator) and the pressure roller 31 (i.e., pressure rotator). The fixing roller 21 heats the toner image to fix the toner image onto the surface of the sheet P. The pressure roller 31 presses against the fixing roller 21 to form the fixing nip through which the sheet P is conveyed between the fixing roller 21 and the pressure roller 31.

In addition, the fixing device 20 of the present embodiment includes the cleaning roller 35 (i.e., cleaner) and the moving assembly 80 that causes the cleaning roller 35 to contact the pressure roller 31 and separates the cleaning roller 35 from the pressure roller 31.

Referring to FIG. 2, the cleaning roller 35 serves as a cleaner that contacts the surface of the pressure roller 31 (i.e., pressure rotator) to clean the surface of the pressure roller 31.

Figure 4A:
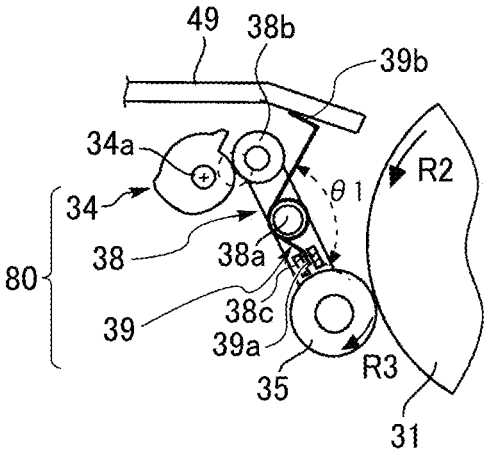
FIG. 4A is a partially enlarged view of the fixing device, illustrating the cleaning roller located at a contact position.
Figure 4B:
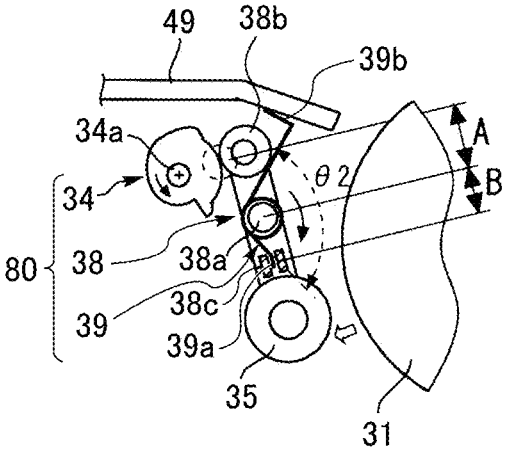
FIG. 4B is a partially enlarged view of the fixing device, illustrating the cleaning roller located at a separate position.

Referring now to FIGS. 2 and 4B, a description is given of the moving assembly 80, which is constructed of the cam 34, the arm 38, and the torsion spring 39.

FIG. 4A is a partially enlarged view of the fixing device 20, illustrating the cleaning roller 35 located at a contact position. FIG. 4B is a partially enlarged view of the fixing device 20, illustrating the cleaning roller 35 located at a separate position.

The moving assembly 80 moves the cleaning roller 35 between the contact position (indicated by a solid line in FIG. 2 and illustrated in FIG. 4A) and the separate position (indicated by a broken line in FIG. 2 and illustrated in FIG. 3 and illustrated in FIGS. 3 and 4B). At the contact position, the cleaning roller 35 contacts the surface of the pressure roller 31 (i.e., pressure rotator) serving as a cleaning target. At the separate position, the cleaning roller 35 is apart from the surface of the pressure roller 31.

That is, the moving assembly 80 allows the cleaning roller 35 to come into contact with and apart from the pressure roller 31.

Specifically, in the present embodiment, the cleaning roller 35 is a metal roller rotatably held by the arm 38. In other words, the arm 38 rotatably holds the cleaning roller 35. The cleaning roller 35 contacts the surface of the pressure roller 31 and removes extraneous matter such as toner and paper dust from the surface of the pressure roller 31. Thus, the cleaning roller 35 cleans the surface of the pressure roller 31. As the surface of the pressure roller 31 is directly cleaned by the cleaning roller 35, the surface of the fixing roller 21 is indirectly cleaned. As a consequence, unfavorable situations are prevented. For example, the sheet P is prevented from being soiled by toner or paper dust while passing through the fixing nip. In addition, a partial loss of an image is prevented.

Particularly in the present embodiment, the cleaning roller 35 rotates together with the pressure roller 31 (i.e., cleaning target) when the cleaning roller 35 is in contact with the pressure roller 31 rotating in a given direction, for example, in the counterclockwise direction of rotation R2 as illustrated in FIG. 2. As the cleaning roller 35 rotates, different portions of the surface of the cleaning roller 35 contact the surface of the pressure roller 31. Accordingly, the cleaning roller 35 efficiently cleans the surface of the pressure roller 31.

Figure 5:
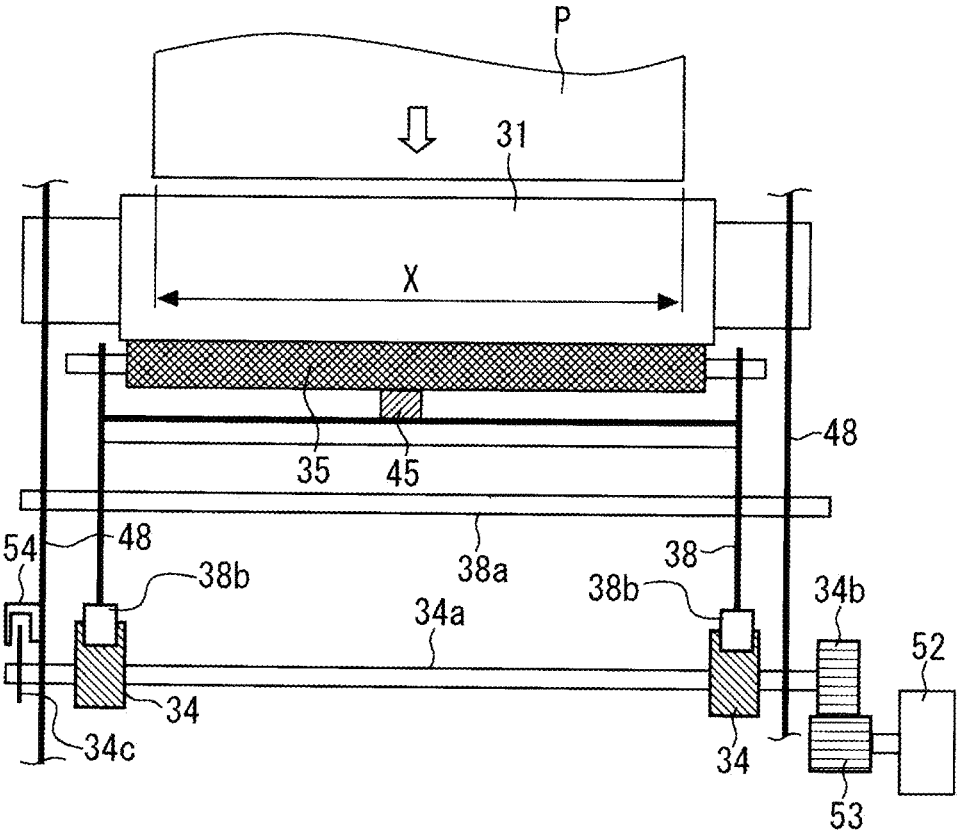
FIG. 5 is a schematic view of the fixing device, illustrating relative positions of components in a width direction of the fixing device.

Note that, as illustrated in FIG. 5, the cleaning roller 35 is configured to contact the pressure roller 31 in a range including a maximum sheet conveyance area X in the fixing nip. The maximum sheet conveyance area X refers to a range in a width direction of a sheet P having a maximum size conveyable through the fixing nip. Accordingly, even when the sheet P of the maximum size is conveyed through the fixing nip, the cleaning roller 35 reliably cleans the surface of the pressure roller 31.

As described above, the fixing device 20 of the present embodiment includes the moving assembly 80, constructed of the cam 34, the arm 38, and the torsion spring 39. The torsion spring 39, which may be referred to as a torsion coil spring, is disposed as a biasing member that presses the cleaning roller 35 (i.e., cleaner) to move to the contact position illustrated in FIGS. 2 and 4A. The moving assembly 80 moves the cleaning roller 35 from the contact position illustrated in FIGS. 2 and 4A to the separate position illustrated in FIGS. 3 and 4B against a biasing force of the torsion spring 39 (i.e., biasing member).

With reference to FIGS. 4A to 5, a detailed description is now given of the moving assembly 80.

FIG. 5 is a schematic view of the fixing device 20, illustrating relative positions of components in a width direction of the fixing device 20.

In the present embodiment, the moving assembly 80 serves as a cam assembly that is constructed of the cam 34, the arm 38, the torsion spring 39 (i.e., biasing member), a driven gear 34*b*, and the like.

The cam 34 is rotatable about a cam shaft 34*a*.

As illustrated in FIG. 5, the cam shaft 34*a* is rotatably supported, through bearings, by unit side plates 48 disposed on opposed end portions of the fixing device 20 in the width direction of the fixing device 20. The cam 34 is disposed at each of opposed longitudinal end portions of the cam shaft 34*a*. A longitudinal direction of the cam shaft 34*a* is parallel to the width direction of the fixing device 20.

The driven gear 34*b* is disposed on one longitudinal end side of the cam shaft 34*a*. The driven gear 34*b* is rotatable together with the cam shaft 34*a*. The driven gear 34*b* meshes with a driving gear 53, which may be referred to as a motor gear, of a motor 52 secured to the image forming apparatus 1 in which the fixing device 20 is disposed. The motor 52 is a forward/reverse bidirectional rotation type motor. The motor 52 rotates the cam 34, together with the cam shaft 34*a*, clockwise and counterclockwise in FIGS. 4A and 4B.

A detected plate 34*c* is disposed on another longitudinal end side of the cam shaft 34*a*. The detected plate 34*c* is rotatable together with the cam shaft 34*a*. A posture of the detected plate 34*c* in a rotational direction of the detected plate 34*c* is optically detected by a photosensor 54 secured to the unit side plate 48. Accordingly, a posture of the cam 34 in a rotational direction of the cam 34 is detected. Note that the posture of the cam 34 in the rotational direction of the cam 34 refers to an angle of the cam 34 (hereinafter referred to as a cam angle), and more particularly to a posture of the cam 34 when the cleaning roller 35 is located at the contact position or the separate position. Based on the posture of the cam 34 in the rotational direction of the cam 34 thus detected, the motor 52 is controlled to accurately move the cleaning roller 35 between the contact position and the separate position.

The arm 38 rotatably holds the cleaning roller 35 (i.e., cleaner) through a bearing.

The arm 38 is rotatable about a pivot 38*a*. The pivot 38*a* is secured to and supported by the unit side plates 48 disposed on the opposed end portions of the fixing device 20 in the width direction of the fixing device 20. The arm 38 is rotatably supported by the pivot 38*a* through a bearing.

The arm 38 is configured to contact the cam 34. A substantially cylindrical cam follower 38*b* is disposed on one longitudinal end side of the arm 38 to contact the cam 34. The cleaning roller 35 is rotatably disposed on another longitudinal end side of the arm 38. The pivot 38*a* is disposed at a longitudinal center portion of the arm 38. The cam follower 38*b* is made of a resin material having a relatively low surface friction coefficient. The two cam follower 38*b* are disposed to contact the respective cams 34 disposed at the opposed longitudinal end portions of the cam shaft 34*a*.

Note that, in the present embodiment, the arm 38 is made of a metal material such as stainless steel. The bearing interposed between the cleaning roller 35 and the arm 38 is made of a conductive resin material. Accordingly, charges are less likely to increase on the cleaning roller 35 or extraneous matter collected by the cleaning roller 35. In other words, the arm 38 and the bearing made of such materials prevent unfavorable situations caused by charging of the cleaning roller 35 or the extraneous matter on the cleaning roller 35.

Referring to FIGS. 4A and 4B, the torsion spring 39 serves as a biasing member that presses and rotates the arm 38 to move the cleaning roller 35 (i.e., cleaner) to the contact position illustrated in FIG. 4A.

The torsion spring 39 (i.e., biasing member) is wound around the pivot 38*a*, thus being supported. The torsion spring 39 includes a first arm portion 39*a* and a second arm portion 39*b* on opposed longitudinal end sides of the torsion spring 39, respectively. The first arm portion 39*a* is hooked on a hook portion 38*c* of the arm 38. The second arm portion 39*b* is hooked on a back side of a guide 49 of the fixing device 20.

Figure 6A:
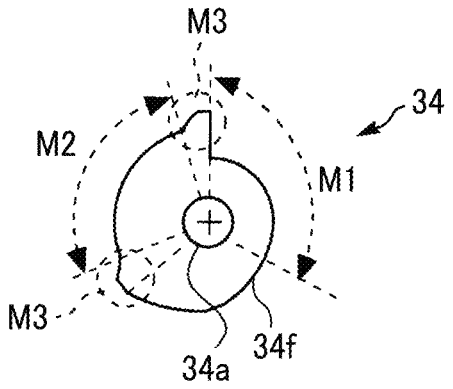
FIG. 6A is a schematic view of a cam incorporated in the fixing device.
Figure 6B:
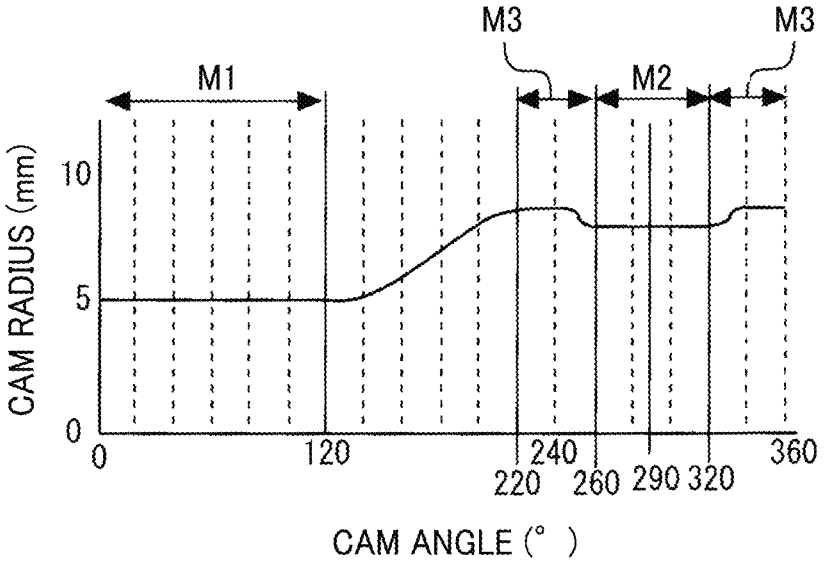
FIG. 6B is a graph illustrating a cam curve of the cam.

With such a configuration of the moving assembly 80, when the motor 52 is driven in a forward direction under the control of the controller 50, a driving force is transmitted from the motor 52 to the cam shaft 34*a* via a gear train constructed of the driven gear 34*b* and the driving gear 53, thereby rotating the cam 34 clockwise from a state illustrated in FIG. 4B to a state illustrated in FIG. 4A. Then, as a radius of the cam 34 gradually decreases, the biasing force of the torsion spring 39 also gradually decreases. Note that the radius of the cam 34 refers to a cam radius from the cam shaft 34*a* to a cam face 34*f*. Accordingly, the arm 38 rotates about the pivot 38*a* counterclockwise in FIGS. 4A and 4B. Eventually, as illustrated in FIG. 4A, a minimum radius portion M1 of the cam 34 comes into contact with the cam follower 38*b*. Note that the minimum radius portion M1 of the cam 34 refers to a portion with the smallest cam radius as illustrated in FIGS. 6A and 6B. That is, the cleaning roller 35 comes into contact with the pressure roller 31 by the biasing force of the torsion spring 39. In other words, the cleaning roller 35 moves to the contact position. When the cleaning roller 35 is in contact with the pressure roller 31, an opening angle θ1 of the torsion spring 39 is minimized. Note that the opening angle θ1 of the torsion spring 39 refers to an angle between the first arm portion 39*a* and the second arm portion 39*b* of the torsion spring 39.

By contrast, when the motor 52 is driven in a reverse direction under the control of the controller 50, the driving force is transmitted from the motor 52 to the cam shaft 34*a* via the gear train constructed of the driven gear 34*b* and the driving gear 53, thereby rotating the cam 34 counterclockwise from the state illustrated in FIG. 4A to the state illustrated in FIG. 4B. Then, as the radius of the cam 34 gradually increases, the biasing force of the torsion spring 39 also gradually increases. The arm 38 rotates about the pivot 38*a* clockwise in FIGS. 4A and 4B against the biasing force of the torsion spring 39. Eventually, as illustrated in FIG. 4B, a large radius portion M2 of the cam 34 comes into contact with the cam follower 38*b*. Note that the large radius portion M2 of the cam 34 refers to a portion with a larger cam radius than the minimum radius portion M1 as illustrated in FIGS. 6A and 6B. That is, the cleaning roller 35 is separated from the pressure roller 31. In other words, the cleaning roller 35 moves to the separate position. When the cleaning roller 35 is apart from the pressure roller 31, an opening angle θ2 of the torsion spring 39 is greater than the opening angle θ1 at which the torsion spring 39 opens when the cleaning roller 35 is in contact with the pressure roller 31. In short, a relation of θ2>θ1 is satisfied.

As described above, the moving assembly 80, constructed of the cam 34, the arm 38, and the torsion spring 39, allows the cleaning roller 35 to come apart from the cleaning roller 35. Compared to a comparative configuration in which a cleaning roller keeps in contact with a pressure roller, the configuration of the present embodiment prevents unfavorable situations such as deformation of the cleaning roller 35 and solidification of toner at the contact position or pressure contact position at which the cleaning roller 35 is pressed against the pressure roller 31.

In the comparative configuration, the cleaning roller keeps in pressure contact with the pressure roller for a relatively long period of time after a fixing device stops driving. As a consequence, the toner positioned at the pressure contact portion may be solidified. The cleaning roller and the pressure roller may be deformed at the pressure contact position. By contrast, in the present embodiment, the cleaning roller 35 is separable from the pressure roller 31 so that the cleaning roller 35 does not keep in contact with the pressure roller 31 for a relatively long period of time when the fixing device 20 stops driving. Thus, the configuration of the present embodiment prevents the unfavorable situations as described above.

Note that, in the present embodiment, when the cleaning roller 35 is in contact with the pressure roller 31, the minimum radius portion M1 of the cam 34 contacts the cam follower 38*b* of the arm 38 as illustrated in FIG. 4A.

However, when the cleaning roller 35 is in contact with the pressure roller 31, the minimum radius portion M1 of the cam 34 may be configured not to contact the cam follower 38*b* of the arm 38. That is, in a process in which the cleaning roller 35 moves from the contact position to the separate position, the cam 34 apart from the cam follower 38*b* comes into contact with the cam follower 38*b*.

In such a configuration, the biasing force of the torsion spring 39 mainly determines the contact pressure of the cleaning roller 35 against the pressure roller 31 at the time when the cleaning roller 35 is in contact with the pressure roller 31, thereby facilitating setting of the contact pressure.

In the present embodiment, when the cleaning roller 35 (i.e., cleaner) is moved from the separate position illustrated in FIG. 4B to the contact position illustrated in FIG. 4A by the operation of the moving assembly 80 constructed of the cam 34, the arm 38, and the torsion spring 39, the biasing force of the torsion spring 39 (i.e., biasing member), which is greater than the biasing force applied when the cleaning roller 35 is located at the contact position, increases and then decreases. In other words, the moving assembly 80 increases the biasing force of the torsion spring 39 greater than the biasing force applied when the cleaning roller 35 is located at the contact position, and then decreases the increased biasing force of the torsion spring 39.

Specifically, when the cleaning roller 35 is moved from the separate position to the contact position by the operation of the moving assembly 80, the biasing force of the torsion spring 39 increases once to a maximum state from a large state to some extent (or sufficiently large state), and then gradually decreases to the minimum state.

In other words, when the cleaning roller 35 is moved from the contact position to the separate position by the operation of the moving assembly 80, the biasing force of the torsion spring 39 gradually increases from the minimum state to the maximum state. After the biasing force of the torsion spring 39 once becomes the maximum state, the biasing force decreases to the sufficiently large state.

More specifically, when the motor 52 is driven to rotate the cam 34 clockwise from the state illustrated in FIG. 4B to the state illustrated in FIG. 4A to move the cleaning roller 35 from the separate position to the contact position as described above, the cam 34 rotates from a state in which the large radius portion M2 (illustrated in FIGS. 6A and 6B) of the cam 34 is in contact with the cam follower 38*b* to a state in which a maximum radius portion M3 of the cam 34 is in contact with the cam follower 38*b*. Note that the maximum radius portion M3 of the cam 34 refers to a portion with the largest cam radius as illustrated in FIGS. 6A and 6B. Thus, the biasing force of the torsion spring 39 temporarily increases. Thereafter, as the cam 34 rotates clockwise and decreases in radius, the biasing force of the torsion spring 39 gradually decreases. Accordingly, the arm 38 rotates about the pivot 38*a* counterclockwise in FIGS. 4A and 4B. Eventually, as illustrated in FIG. 4A, the minimum radius portion M1 (illustrated in FIGS. 6A and 6B) of the cam 34 comes into contact with the cam follower 38*b*. The biasing force of the torsion spring 39 causes the cleaning roller 35 to contact the pressure roller 31.

When the cleaning roller 35 moves from the contact position to the separate position, the reverse operation is performed.

An operator, for example, may accidentally touch the moving assembly 80 (e.g., driven gear 34*b*) and apply an unexpected external force to the moving assembly 80 when the operator removes the fixing device 20 from the image forming apparatus 1 or when the operator removes a sheet P jammed in the fixing device 20. Even when the moving assembly 80 is applied with the unexpected external force in such a situation, the moving assembly 80 configured as described above does not erroneously move the cleaning roller 35 from the separate position to the contact position provided that a rotational force sufficient to cause the cam follower 38*b* to climb over the maximum radius portion M3 of the cam 34 does not act. Accordingly, the fixing device 20 of the present embodiment prevents unfavorable situations caused by the cleaning roller 35 failing to come apart from the pressure roller 31 as described above.

In the present embodiment, the cam radius of the maximum radius portion M3 is increased simply by about 5% to about 15% from the cam radius of the large radius portion M2, thereby preventing obstruction of a general contact/separation operation of the cleaning roller 35 described above with reference to FIGS. 4A and 4B.

Referring now to FIGS. 6A and 6B, a detailed description is given of the cam 34.

FIG. 6A is a schematic view of the cam 34 according to the present embodiment. FIG. 6B is a graph illustrating a cam curve of the cam 34.

Specifically, the cam curve indicates a shape of the cam face 34*f* of the cam 34. In FIG. 6B, the horizontal axis indicates the angle of the cam 34 (i.e., cam angle); whereas the vertical axis indicates the radius of the cam 34 (i.e., cam radius).

As illustrated in FIGS. 6A and 6B, in the present embodiment, the large radius portion M2 on the cam face 34*f* (i.e., outer circumferential surface) of the cam 34 is in a range of about 60 degrees or greater around the cam shaft 34*a*. As described above, the cam 34 has the large radius portion M2 to locate the cleaning roller 35 at the separate position illustrated in FIG. 4B. Specifically, in the present embodiment, the large radius portion M2 of the cam 34 is in a range of about 60 degrees around the cam shaft 34*a*. The maximum radius portion M3 having a larger radius (or cam radius) than the cam radius of the large radius portion M2 is adjacent to the large radius portion M2. In the present embodiment, each circumferential side of the large radius portion M2 is adjacent to the maximum radius portion M3.

The large radius portion M2 in the range of about 60 degrees or greater around the cam shaft 34*a* of the cam 34 sufficiently exhibits the advantages described above.

In the present embodiment, the fixing device 20 is removable from the image forming apparatus 1. Specifically, a cover of the image forming apparatus 1 is opened and closed to remove the fixing device 20 from the image forming apparatus 1 in a direction RD in FIGS. 7B and 7C or to install the fixing device 20 in the image forming apparatus 1 in a direction opposite the direction RD.

The moving assembly 80, constructed of the cam 34, the arm 38, and the torsion spring 39, moves the cleaning roller 35 from the contact position to the separate position before the fixing device 20 is removed from the image forming apparatus 1. Specifically, as described later, when the driving of the fixing device 20 is stopped, the cleaning roller 35 is moved from the contact position to the separate position by the motor 52 under the control of the controller 50.

Figure 7A:
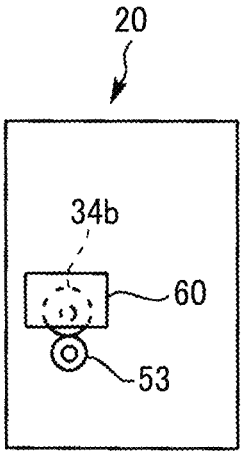
FIG. 7A is a schematic diagram illustrating a first state of movements of a driving gear and a driven gear when the fixing device is removed from the image forming apparatus.
Figure 7B:
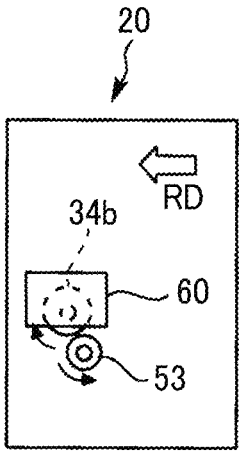
FIG. 7B is a schematic diagram illustrating a second state of movements of the driving gear and the driven gear when the fixing device is removed from the image forming apparatus.
Figure 7C:
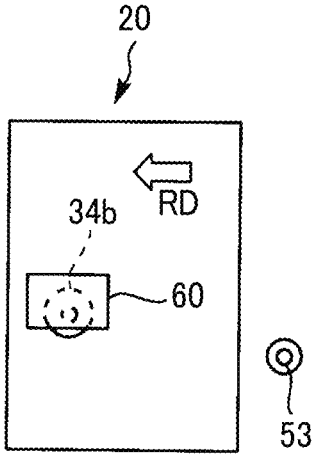
FIG. 7C is a schematic diagram illustrating a third state of movements of the driving gear and the driven gear when the fixing device is removed from the image forming apparatus.

FIGS. 7A to 7C illustrate how the driving gear 53 and the driven gear 34*b* move when the fixing device 20 is removed from the image forming apparatus 1. FIG. 7A is a schematic diagram illustrating a first state of movements of the driving gear 53 and the driven gear 34*b* when the fixing device 20 is removed from the image forming apparatus 1. FIG. 7B is a schematic diagram illustrating a second state of movements of the driving gear 53 and the driven gear 34*b* when the fixing device 20 is removed from the image forming apparatus 1. FIG. 7C is a schematic diagram illustrating a third state of movements of the driving gear 53 and the driven gear 34*b* when the fixing device 20 is removed from the image forming apparatus 1.

As illustrated in FIGS. 7A to 7C, in the present embodiment, the driven gear 34*b* meshing with the driving gear 53 of the image forming apparatus 1 rotates clockwise in FIGS. 7A to 7C and comes apart from the driving gear 53 in conjunction with removal of the fixing device 20 from the image forming apparatus 1. At this time, in the present embodiment, the cleaning roller 35 remains at the separate position. Specifically, an angle range of the large radius portion M2 of the cam 34 (in the present embodiment, the range of about 60 degrees around the cam shaft 34*a*) is set to be greater than an angle at which the driven gear 34*b* rotates when the fixing device 20 is removed from the image forming apparatus 1. In the present embodiment, the fixing device 20 is designed such that the cleaning roller 35 remains at the separate position when a center position of the large radius portion M2 of the cam 34 is in contact with the cam follower 38*b*. Note that the center position of the large radius portion M2 of the cam 34 is a position at which the cam angle is 290 degrees. Therefore, the angle range of the large radius portion M2 is preferably set to be twice or more the angle at which the driven gear 34*b* rotates when the fixing device 20 is removed from the image forming apparatus 1.

Such a configuration prevents the cleaning roller 35 from moving from the separate position to the contact position when the moving assembly 80 constructed of the cam 34, the arm 38, and the torsion spring 39 is erroneously operated when the fixing device 20 is removed from the image forming apparatus 1.

Note that, in the present embodiment, a cover 60 is disposed so as to cover most of the driven gear 34*b* while exposing a meshing portion of the driven gear 34*b* meshing with the driving gear 53 (and the vicinity of the meshing portion) alone from the fixing device 20, thereby preventing the operator from accidentally touching the driven gear 34*b* when installing or removing the fixing device 20 in or from the image forming apparatus 1.

In the present embodiment, as illustrated in FIG. 4B, the pivot 38*a* is located between a contact part at which the arm 38 contacts the cam 34 and a point of effort at which the torsion spring 39 (i.e., biasing member) presses the arm 38. As illustrated in FIG. 4B, a relation of $A/B \leq 1.5$ is satisfied, where A represents a distance between the contact part and the pivot 38*a* and B represents a distance between the point of effort and the pivot 38*a*.

In the relation of balance between the rotational moment at the contact part and the rotational moment at the point of effort, the smaller the ratio A/B is, the greater the force exerted by the arm 38 to press the cam 34 becomes when the cleaning roller 35 is separated from the pressure roller 31. In short, the cam 34 becomes hard to rotate. Accordingly, satisfaction of the relation of $A/B \leq 1.5$ prevents the cleaning roller 35 from moving from the separate position to the contact position due to an unexpected external force. If the ratio A/B is too large, the cleaning roller 35 is hard to be sufficiently separated unless the cam 34 largely moves the cam follower 38*b*.

To address such a situation, the relation of $A/B \leq 1.5$ is preferably satisfied. Note that, in the present embodiment, the ratio A/B is set to about 1.02.

Referring now to FIGS. 2, 3, 5, a detailed description is given of the temperature sensor 45. The fixing device 20 of the present embodiment includes the temperature sensor 45 serving as a temperature detector that detects the temperature of the cleaning roller 35 (i.e., cleaner).

Specifically, the temperature sensor 45 is a contact temperature sensor such as a contact thermistor. The temperature sensor 45 is held by the arm 38 such that a detection surface of the temperature sensor 45 contacts the cleaning roller 35. That is, the temperature sensor 45 is disposed in contact with the cleaning roller 35 to detect the temperature of the cleaning roller 35, regardless of whether the cleaning roller 35 is in contact with the pressure roller 31 or apart from the pressure roller 31.

In the fixing device 20 according to the present embodiment, in a case in which the temperature detected by the temperature sensor 45 (i.e., temperature detector) is greater than a given value A, the moving assembly 80, constructed of the cam 34, the arm 38, and the torsion spring 39, moves the cleaning roller 35 (i.e., cleaner) from the contact position (illustrated in FIG. 2) to the separate position (illustrated in FIG. 3) or from the separate position to the contact position during rotation of the pressure roller 31, which is a cleaning or contact target for the cleaning roller 35 to clean the surface of the pressure roller 31.

On the other hand, in a case in which the temperature detected by the temperature sensor 45 (i.e., temperature detector) is equal to or smaller the given value A, the moving assembly 80, constructed of the cam 34, the arm 38, and the torsion spring 39, moves the cleaning roller 35 (i.e., cleaner) from the contact position to the separate position or from the separate position to the contact position during a stop of rotation of the pressure roller 31 (i.e., cleaning target).

Figure 8A:
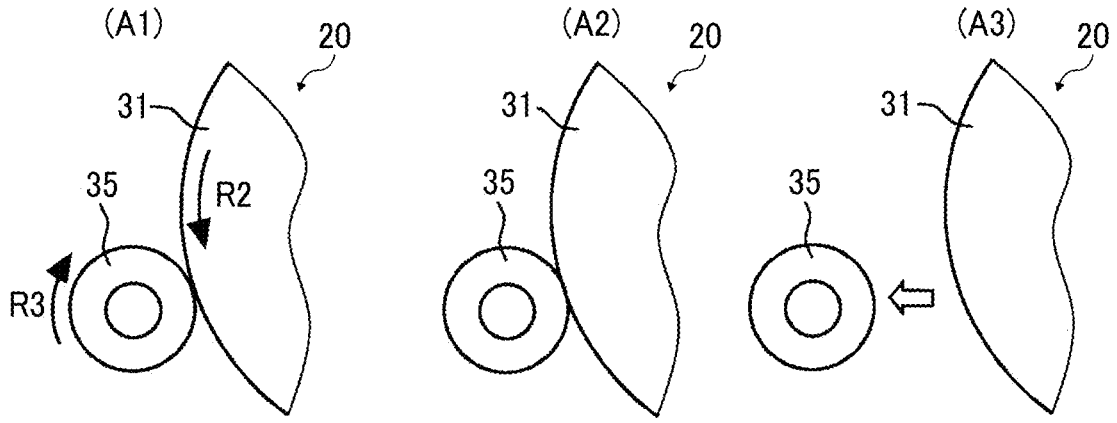
FIG. 8A is a diagram illustrating rotary motions of the pressure roller in association with separation of the cleaning roller from the pressure roller when a detected temperature is equal to or smaller than a given value.
Figure 8B:
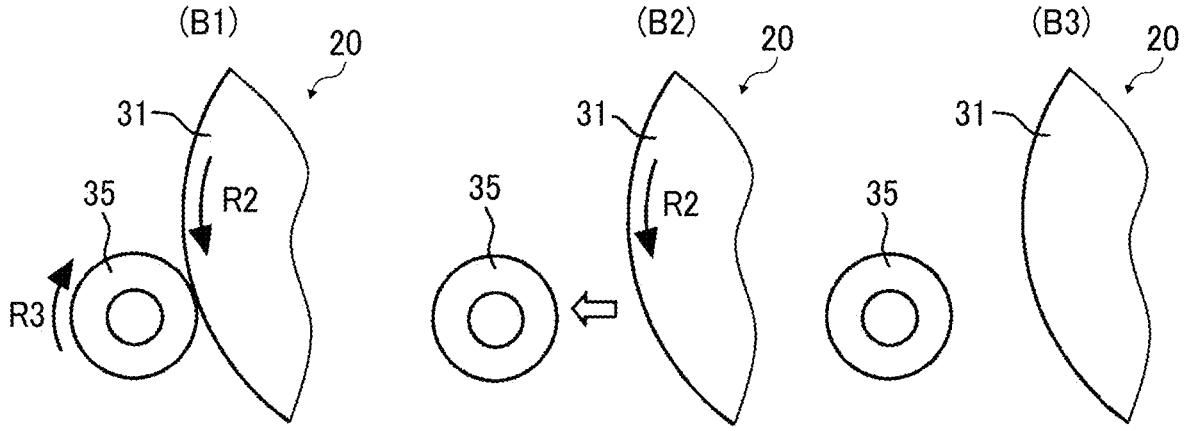
FIG. 8B is a diagram illustrating rotary motions of the pressure roller in association with separation of the cleaning roller from the pressure roller when the detected temperature is greater than the given value.

Referring now to FIGS. 8A and 8B, a detailed description is given of movements of the pressure roller 31 and the cleaning roller 35 when the cleaning roller 35 is separated from the pressure roller 31 in the fixing device 20.

FIG. 8A is a diagram illustrating rotary motions of the pressure roller 31 in association with separation of the cleaning roller 35 from the pressure roller 31 when the temperature of the cleaning roller 35 detected by the temperature sensor 45 (i.e., detected temperature) is equal to or smaller than the given value A.

As illustrated in Section (A1) of FIG. 8A, as the pressure roller 31 is rotated together with the fixing roller 21 by the drive motor 51 under the control of the controller 50, the cleaning roller 35 in contact with the pressure roller 31 is also rotated in a clockwise direction of rotation R3. When the controller 50 determines that it is time to separate the cleaning roller 35 from the pressure roller 31, the drive motor 51 stops driving and rotating the fixing roller 21, thereby stopping rotation of the pressure roller 31 while the cleaning roller 35 is kept in contact with the pressure roller 31 as illustrated in Section (A2) of FIG. 8A. Then, as illustrated in Section (A3) of FIG. 8A, the cleaning roller 35 is separated from the pressure roller 31 not rotating.

On the other hand, FIG. 8B is a diagram illustrating rotary motions of the pressure roller 31 in association with separation of the cleaning roller 35 from the pressure roller 31 when the temperature of the cleaning roller 35 detected by the temperature sensor 45 (i.e., detected temperature) is greater than the given value A.

As illustrated in Section (B1) of FIG. 8B, as the pressure roller 31 is rotated together with the fixing roller 21 by the drive motor 51 under the control of the controller 50, the cleaning roller 35 in contact with the pressure roller 31 is also rotated in the clockwise direction of rotation R3. When the controller 50 determines that it is time to separate the cleaning roller 35 from the pressure roller 31, the cleaning roller 35 is separated from the pressure roller 31 while the drive motor 51 keeps driving and rotating the fixing roller 21, thereby keeping rotation of the pressure roller 31 as illustrated in Section (B2) of FIG. 8B. Then, as illustrated in Section (B3) of FIG. 8B, the drive motor 51 stops driving and rotating the fixing roller 21, thereby stopping rotation of the pressure roller 31 after the cleaning roller 35 is separated from the pressure roller 31.

Thus, in the fixing device 20, the cleaning roller 35 is separated from the pressure roller 31 while the pressure roller 31 stops rotating or while the pressure roller 31 keeps rotating, depending on the temperature of the cleaning roller 35. Accordingly, the fixing device 20 maintains an enhanced cleanability of the cleaning roller 35 while preventing the extraneous matter such as toner adhering to the surface of the cleaning roller 35 from returning to the surface of the pressure roller 31.

Figure 11A:
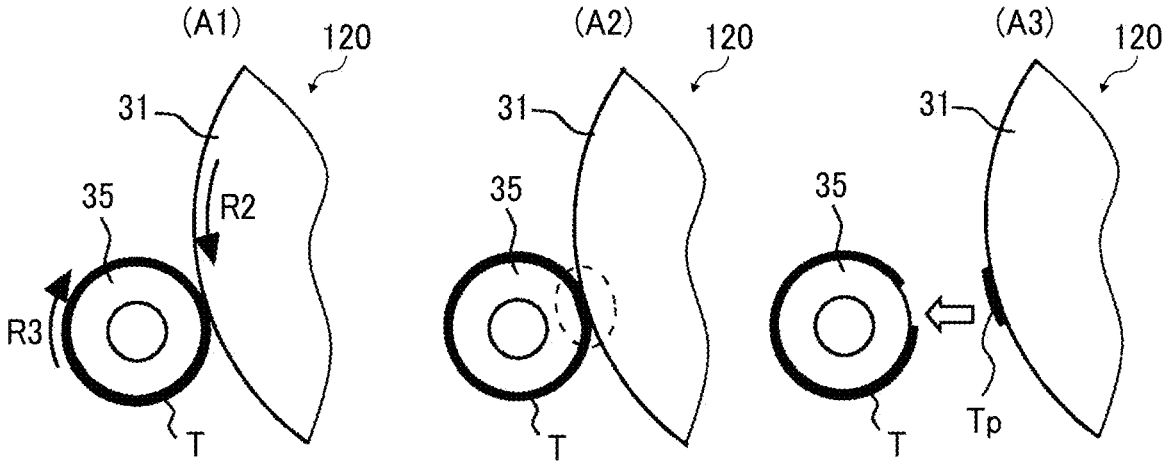
FIG. 11A is a diagram illustrating rotary motions of the pressure roller in association with separation of the cleaning roller from the pressure roller in a comparative fixing device.

To provide a fuller understanding of the embodiments of the present disclosure, a description is now given of movements of the pressure roller 31 and the cleaning roller 35 when the cleaning roller 35 is separated from the pressure roller 31 in a comparative fixing device 120, with reference to FIG. 11A.

FIG. 11A is a diagram illustrating rotary motions of the pressure roller 31 in association with separation of the cleaning roller 35 from the pressure roller 31 in the comparative fixing device 120.

Specifically, Section (A1) of FIG. 11A illustrates that the cleaning roller 35 in contact with the pressure roller 31 is rotated in the clockwise direction of rotation R3 by the pressure roller 31 that rotates in the counterclockwise direction of rotation R2. Section (A2) of FIG. 11A illustrates that the pressure roller 31 stops rotating while the cleaning roller 35 is kept in contact with the pressure roller 31. Section (A3) of FIG. 11A illustrates that the cleaning roller 35 is separated from the pressure roller 31 not rotating. When the cleaning roller 35 is separated from the pressure roller 31 not rotating, an unfavorable situation may arise. Specifically, as illustrated in Section (A3) of FIG. 11A, extraneous matter such as the toner T adhering to the surface of the cleaning roller 35 may partially move or return, as partial extraneous matter Tp, to the surface of the pressure roller 31 from the pressure contact position, encompassed by a broken line in Section (A2) of FIG. 11A, between the pressure roller 31 and the cleaning roller 35. Such an unfavorable situation arises depending on whether the temperature of the cleaning roller 35 reaches the given value A (hereinafter occasionally referred to as a melting temperature) or not when the cleaning roller 35 is separated from the pressure roller 31. Specifically, such an unfavorable situation arises when the temperature of the extraneous matter (e.g., toner T) on the cleaning roller 35 reaches a high temperature (i.e., melting temperature) together with the cleaning roller 35. The extraneous matter reaching the melting temperature melts and moves toward the pressure roller 31. In short, the extraneous matter is offset.

The given value A (i.e., melting temperature) described above is a maximum temperature that does not cause the unfavorable situation in which the extraneous matter (mainly toner), which has moved from the surface of the pressure roller 31 to the surface of the cleaning roller 35, returns to the surface of the pressure roller 31. In other words, the given value A is a maximum temperature that does not cause the extraneous matter to return from the surface of the cleaning roller 35 to the surface of the pressure roller 31 (i.e., cleaning target).

The unfavorable situation described above soils the surface of the pressure roller 31. As a consequence, the sheet P is also soiled while passing through the fixing nip. In addition, an image formed on the sheet P may be partially lost. In addition, such reverse movement of extraneous matter causes an uneven layer of the extraneous matter on the surface of the cleaning roller 35 as illustrated in Section (A3) of FIG. 11A. When the cleaning roller 35 contacts the pressure roller 31 again, the cleaning roller 35 may cause a rotation failure, resulting in a cleaning failure.

To address such situations, in the present embodiment, when the temperature of the cleaning roller 35 reaches the given value A (i.e., melting temperature) and therefore the reverse movement of the extraneous matter (as the partial extraneous matter Tp) is likely to occur, the cleaning roller 35 is separated from the pressure roller 31 while the pressure roller 31 keeps rotating. That is, the cleaning roller 35 is separated from the pressure roller 31 without causing a local pressure contact portion on the cleaning roller 35. Accordingly, the unfavorable situation described above is prevented.

On the other hand, in the present embodiment, when the temperature of the cleaning roller 35 does not reach the given value A (i.e., melting temperature) and therefore the reverse movement of the extraneous matter (as the partial extraneous matter Tp) is unlikely to occur, the cleaning roller 35 is separated from the pressure roller 31 while the pressure roller 31 stops rotating. Such a configuration prevents the cleaning roller 35 from failing to clean the pressure roller 31 from when the cleaning roller 35 is separated from the pressure roller 31 until when the pressure roller 31 stops rotating.

In short, the cleaning roller 35 is separated from the pressure roller 31 while the pressure roller 31 keeps rotating when the temperature of the cleaning roller 35 is high enough to cause the reverse movement of the extraneous matter (as the partial extraneous matter Tp). By contrast, when the temperature of the cleaning roller 35 is insufficient to cause the reverse movement of the extraneous matter (as the partial extraneous matter Tp), the cleaning roller 35 is separated from the pressure roller 31 after the pressure roller 31 stops rotating. Accordingly, in the present embodiment, the cleaning roller 35 exhibits an enhanced cleanability.

Figure 9A:
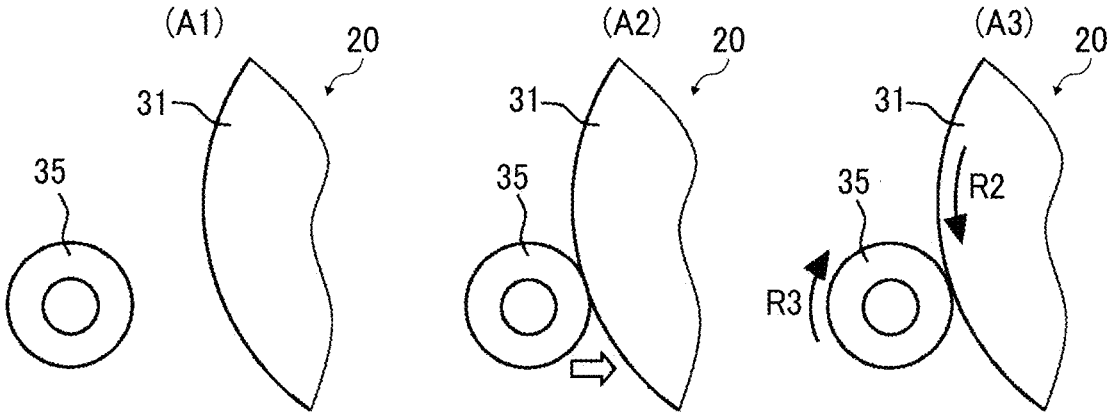
FIG. 9A is a diagram illustrating rotary motions of the pressure roller in association with the cleaning roller coming into contact with the pressure roller when the detected temperature is equal to or smaller than the given value.
Figure 9B:
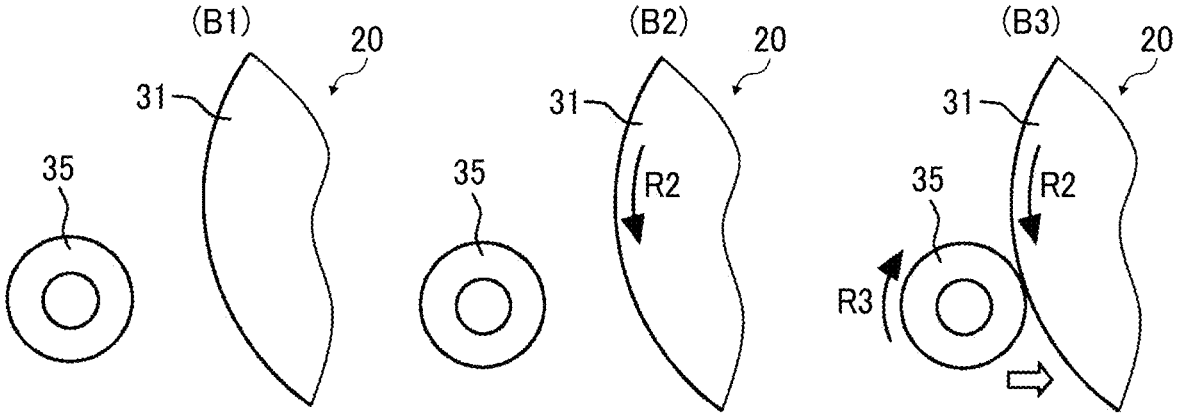
FIG. 9B is a diagram illustrating rotary motions of the pressure roller in association with the cleaning roller coming into contact with the pressure roller when the detected temperature is greater than the given value.

Referring now to FIGS. 9A and 9B, a detailed description is given of movements of the pressure roller 31 and the cleaning roller 35 when the cleaning roller 35 comes into contact with the pressure roller 31 in the fixing device 20.

FIG. 9A is a diagram illustrating rotary motions of the pressure roller 31 in association with the cleaning roller 35 coming into contact with the pressure roller 31 when the temperature of the cleaning roller 35 detected by the temperature sensor 45 (i.e., detected temperature) is equal to or smaller than the given value A.

As illustrated in Section (A1) of FIG. 9A, the rotation of the pressure roller 31 is stopped together with the fixing roller 21 by the drive motor 51 under the control of the controller 50; whereas the cleaning roller 35 is separated from the pressure roller 31. When the controller 50 determines that it is time for the cleaning roller 35 to come into contact with the pressure roller 31, the cleaning roller 35 comes into contact with the pressure roller 31 while the drive motor 51 stops driving and rotating the fixing roller 21, thereby stopping rotation of the pressure roller 31 as illustrated in Section (A2) of FIG. 9A. Then, as illustrated in Section (A3) of FIG. 9A, the drive motor 51 drives and rotates the fixing roller 21, thereby rotating the pressure roller 31 after the cleaning roller 35 contacts the pressure roller 31.

On the other hand, FIG. 9B is a diagram illustrating rotary motions of the pressure roller 31 in association with the cleaning roller 35 coming into contact with the pressure roller 31 when the temperature of the cleaning roller 35 detected by the temperature sensor 45 (i.e., detected temperature) is greater than the given value A.

As illustrated in Section (B1) of FIG. 9B, the rotation of the pressure roller 31 is stopped together with the fixing roller 21 by the drive motor 51 under the control of the controller 50; whereas the cleaning roller 35 is separated from the pressure roller 31. When the controller 50 determines that it is time for the cleaning roller 35 to come into contact with the pressure roller 31, the drive motor 51 drives and rotates the fixing roller 21, thereby rotating the pressure roller 31 while the cleaning roller 35 is apart from the pressure roller 31 as illustrated in Section (B2) of FIG. 9B. Then, as illustrated in Section (B3) of FIG. 9B, the cleaning roller 35 comes into contact with the pressure roller 31 rotating.

Thus, in the fixing device 20, the cleaning roller 35 comes into contact with the pressure roller 31 while the pressure roller 31 stops rotating or while the pressure roller 31 keeps rotating, depending on the temperature of the cleaning roller 35. Accordingly, the fixing device 20 maintains an enhanced cleanability of the cleaning roller 35 while preventing the extraneous matter such as toner adhering to the surface of the cleaning roller 35 from returning to the surface of the pressure roller 31.

Figure 11B:
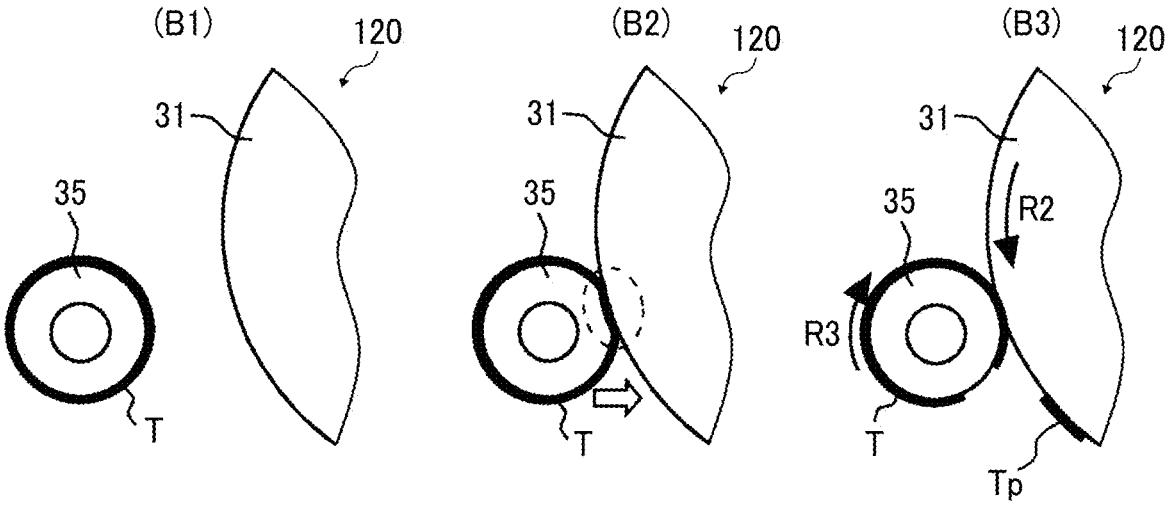
FIG. 11B is a diagram illustrating rotary motions of the pressure roller in association with the cleaning roller coming into contact with the pressure roller in the comparative fixing device.

To provide a fuller understanding of the embodiments of the present disclosure, a description is now given of movements of the pressure roller 31 and the cleaning roller 35 when the cleaning roller 35 comes into contact with the pressure roller 31 in the comparative fixing device 120, with reference to FIG. 11B.

FIG. 11B is a diagram illustrating rotary motions of the pressure roller 31 in association with the cleaning roller 35 coming into contact with the pressure roller 31 in the comparative fixing device 120.

Specifically, Section (B1) of FIG. 11B illustrates that the cleaning roller 35 is separated from the pressure roller 31 not rotating. Section (B2) of FIG. 11B illustrates that the cleaning roller 35 comes into contact with the pressure roller 31 while the pressure roller 31 stops rotation. Section (B3) of FIG. 11B illustrates that the cleaning roller 35 in contact with the pressure roller 31 is rotated in the clockwise direction of rotation R3 by the pressure roller 31 that rotates in the counterclockwise direction of rotation R2. When the cleaning roller 35 contacts the pressure roller 31 not rotating, an unfavorable situation may arise. Specifically, as illustrated in Section (B3) of FIG. 11B, the extraneous matter such as the toner T adhering to the surface of the cleaning roller 35 may partially move or return, as partial extraneous matter Tp, to the surface of the pressure roller 31 from the pressure contact position, encompassed by a broken line in Section (B2) of FIG. 11B, between the pressure roller 31 and the cleaning roller 35. Such an unfavorable situation arises depending on whether the temperature of the cleaning roller 35 reaches the given value A (i.e., melting temperature) or not when the cleaning roller 35 contacts the pressure roller 31. Specifically, such an unfavorable situation arises when the temperature of the extraneous matter (e.g., toner T) on the cleaning roller 35 reaches a high temperature (i.e., melting temperature) together with the cleaning roller 35. The extraneous matter reaching the melting temperature melts and moves toward the pressure roller 31. In short, the extraneous matter is offset as in the example described above with reference to FIG. 11A in which the cleaning roller 35 is separated from the pressure roller 31.

The unfavorable situation described above soils the surface of the pressure roller 31. As a consequence, the sheet P is also soiled while passing through the fixing nip. In addition, an image formed on the sheet P may be partially lost. In addition, such reverse movement of extraneous matter causes an uneven layer of the extraneous matter on the surface of the cleaning roller 35 as illustrated in Section (B3) of FIG. 11B. As a consequence, the cleaning roller 35 may cause a rotation failure, resulting in a cleaning failure.

To address such situations, in the present embodiment, when the temperature of the cleaning roller 35 reaches the given value A (i.e., melting temperature) and therefore the reverse movement of the extraneous matter (as the partial extraneous matter Tp) is likely to occur, the cleaning roller 35 comes into contact with the pressure roller 31 while the pressure roller 31 keeps rotating. That is, the cleaning roller 35 contacts the pressure roller 31 without causing a local pressure contact portion on the cleaning roller 35. Accordingly, the unfavorable situation described above is prevented.

On the other hand, in the present embodiment, when the temperature of the cleaning roller 35 does not reach the given value A (i.e., melting temperature) and therefore the reverse movement of the extraneous matter (as the partial extraneous matter Tp) is unlikely to occur, the cleaning roller 35 comes into contact with the pressure roller 31 while the pressure roller 31 stops rotating. Such a configuration prevents the cleaning roller 35 from failing to clean the pressure roller 31 from when the pressure roller 31 starts rotating until when the cleaning roller 35 contacts the pressure roller 31.

In short, the cleaning roller 35 comes into contact with the pressure roller 31 while the pressure roller 31 keeps rotating when the temperature of the cleaning roller 35 is high enough to cause the reverse movement of the extraneous matter (as the partial extraneous matter Tp). By contrast, when the temperature of the cleaning roller 35 is insufficient to cause the reverse movement of the extraneous matter (as the partial extraneous matter Tp), the cleaning roller 35 comes into contact with the pressure roller 31 while the pressure roller 31 stops rotating. Accordingly, in the present embodiment, the cleaning roller 35 exhibits an enhanced cleanability.

The melting temperature described above varies depending on the toner used, the components of the paper powder, and the like. Therefore, the given value A described above is settable to an optimum value for each model of image forming apparatus employing different types of toner. The given value A described above is also variable according to the sheet P conveyed.

In the present embodiment, based on a surface temperature of the cleaning roller 35 directly detected by the temperature sensor 45 (i.e., temperature detector), the controller 50 determines whether to cause the cleaning roller 35 to come into contact with or apart from the pressure roller 31 while the pressure roller 31 stops rotating or whether to cause the cleaning roller 35 to come into contact with or apart from the pressure roller 31 while the pressure roller 31 keeps rotating.

Alternatively, when the temperature of the cleaning roller 35 is indirectly detected by detection of the temperature of the pressure roller 31 due to a relatively high correlation between the change in the surface temperature of the pressure roller 31 and the change in the surface temperature of the cleaning roller 35, the controller 50 determines whether to cause the cleaning roller 35 to come into contact with or apart from the pressure roller 31 while the pressure roller 31 stops rotating or whether to cause the cleaning roller 35 to come into contact with or apart from the pressure roller 31 while the pressure roller 31 keeps rotating, based on the temperature of the pressure roller 31 detected by the temperature sensor 41 (i.e., temperature detector). Since such a configuration reduces the number of temperature sensors, the fixing device can be downsized and manufactured at reduced cost.

Figure 10A:
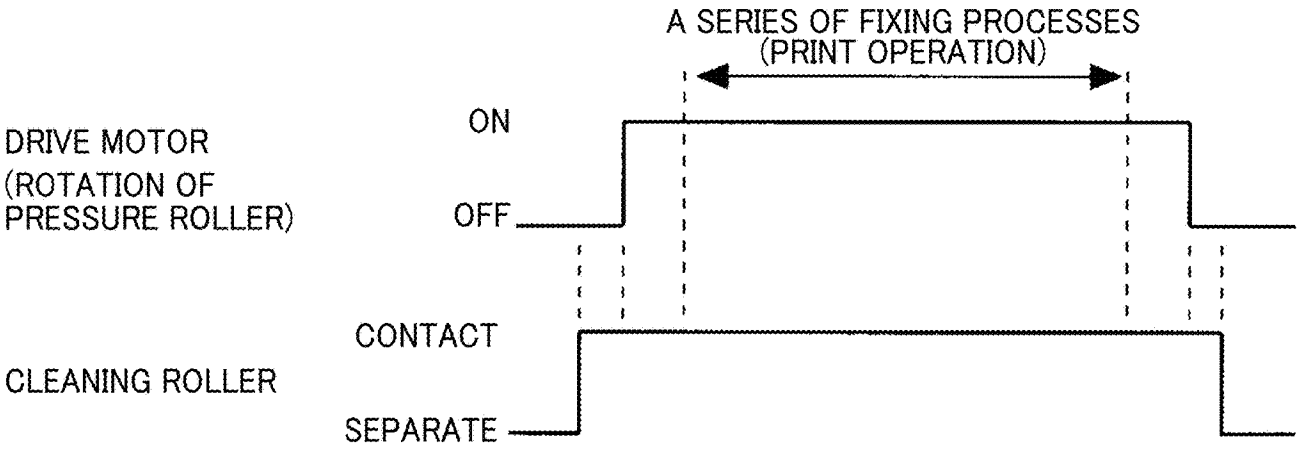
FIG. 10A is a timing chart illustrating a rotation control of the pressure roller and a contact/separation control of the cleaning roller when the detected temperature is equal to or smaller than the given value.
Figure 10B:
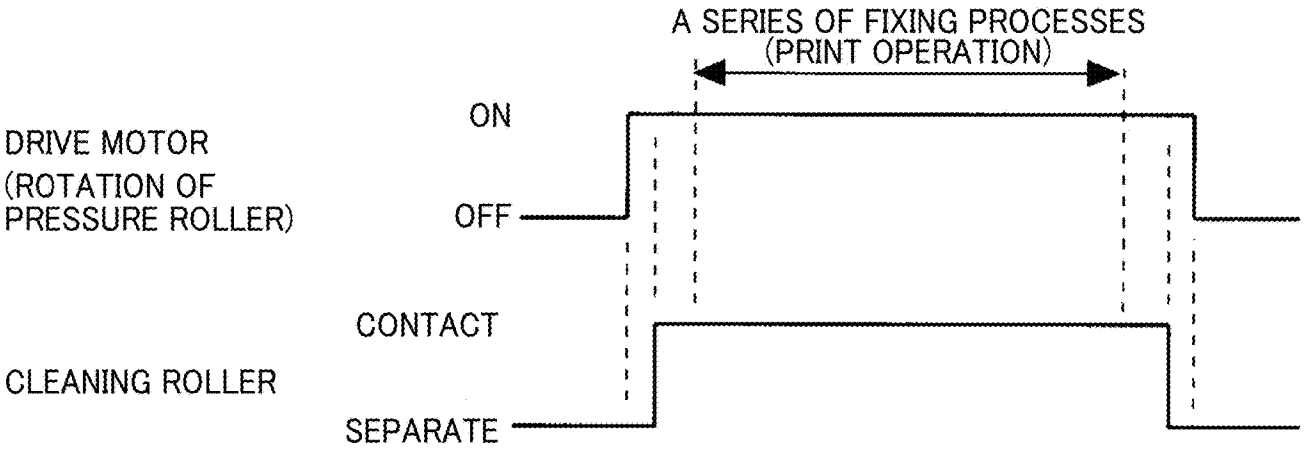
FIG. 10B is a timing chart illustrating the rotation control of the pressure roller and the contact/separation control of the cleaning roller when the detected temperature is greater than the given value.

Referring now to FIGS. 10A and 10B, a description is given of the timing of rotation of the pressure roller 31 and the timing of contact/separation of the cleaning roller 35 with respect to a series of fixing processes.

FIG. 10A is a timing chart illustrating a rotation control of the pressure roller 31 and a contact/separation control of the cleaning roller 35 when the detected temperature is equal to or smaller than the given value A. FIG. 10B is a timing chart illustrating the rotation control of the pressure roller 31 and the contact/separation control of the cleaning roller 35 when the detected temperature is greater than the given value A.

In the present embodiment, the moving assembly 80 moves the cleaning roller 35 (i.e., cleaner) from the separate position to the contact position before the series of fixing processes (i.e., print operation) starts. Specifically, as illustrated in FIGS. 10A and 10B, the cleaning roller 35 is located at the contact position, from the separate position, at the time when the series of fixing processes (i.e., print operation) starts, regardless of whether the temperature detected by the temperature sensor 45 is greater than the given value A or not. That is, at the time of warming up before the series of fixing processes, the cleaning roller 35 comes into contact with the pressure roller 31 while the pressure roller 31 stops rotating or while the pressure roller 31 keeps rotating, based on the temperature detected by the temperature sensor 45.

Similarly, the moving assembly 80 moves the cleaning roller 35 from the contact position to the separate position after the series of fixing processes (i.e., print operation) is completed. Specifically, as illustrated in FIGS. 10A and 10B, the cleaning roller 35 is eventually located at the separate position, from the contact position, after the series of fixing processes (i.e., print operation) is completed, regardless of whether the temperature detected by the temperature sensor 45 is greater than the given value A or not. That is, at the time of cooling down after the series of fixing processes, the cleaning roller 35 is separated from the pressure roller 31 while the pressure roller 31 stops rotating or while the pressure roller 31 keeps rotating, based on the temperature detected by the temperature sensor 45.

Such rotation control of the pressure roller 31 and the contact/separation control of the cleaning roller 35 maintain a reliable series of fixing processes while providing various advantages described above.

Figure 12A:
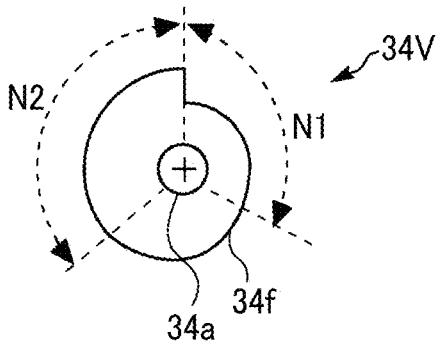
FIG. 12A is a schematic view of a first variation of the cam.
Figure 12B:
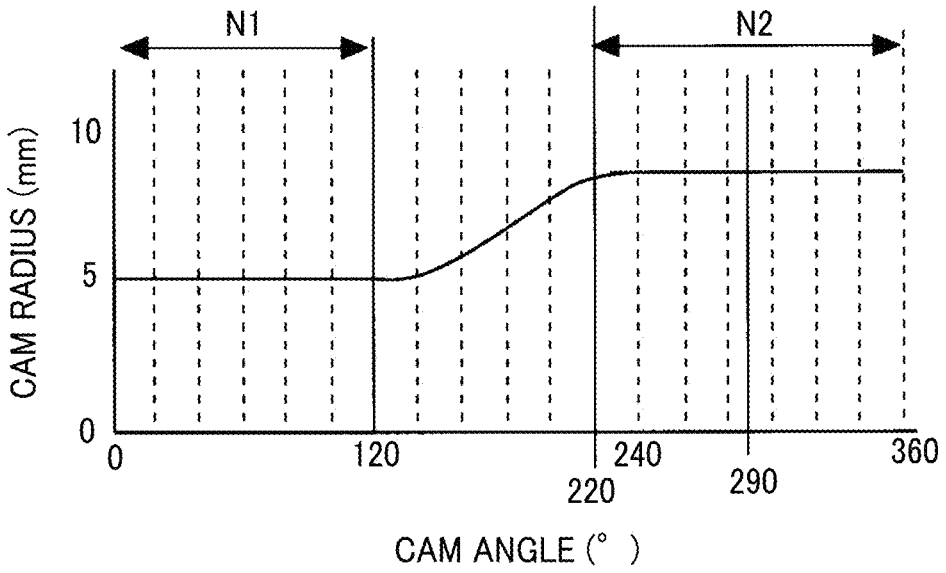
FIG. 12B is a graph illustrating a cam curve in the first variation.

Referring now to FIGS. 12A and 12B, a description is given of a first variation of the cam 34 described above.

FIG. 12A is a schematic view of a cam 34V as the first variation of the cam 34 illustrated in FIG. 6A. FIG. 12B is a graph illustrating a cam curve of the cam 34V in the first variation, corresponding to the graph illustrated in FIG. 6B.

Specifically, the cam curve indicates a shape of the cam face 34*f* of the cam 34V. The cam 34V, as a part of the moving assembly 80, is different from the cam 34 described above in the shape of the cam face 34*f*.

In the first variation, when the cleaning roller 35 (i.e., cleaner) is moved from the separate position to the contact position by the operation of the moving assembly 80 constructed of the cam 34V, the arm 38, and the torsion spring 39, the biasing force of the torsion spring 39 (i.e., biasing member) continues to be greater than the biasing force applied when the cleaning roller 35 is located at the contact position, and then decreases. In other words, the moving assembly 80 maintains the biasing force of the torsion spring 39 to be greater than the biasing force applied when the cleaning roller 35 is located at the contact position, and then decreases the maintained biasing force of the torsion spring 39.

That is, when the cleaning roller 35 is located at the separate position, the biasing force of the torsion spring 39 is maximized. When the moving assembly 80 operates to move the cleaning roller 35 from the separate position to the contact position, the moving assembly 80 remains against the maximized biasing force of the torsion spring 39 while the cam 34V rotates in or over a given range.

Specifically, when the motor 52 drives and rotate the cam 34V clockwise to move the cleaning roller 35 from the separate position to the contact position as described above, a maximum radius portion N2 of the cam 34V keeps in contact with the cam follower 38*b* for a while. Note that the maximum radius portion N2 of the cam 34V refers to a portion with the largest cam radius as illustrated in FIGS. 12A and 12B. That is, the torsion spring 39 also keeps a maximum biasing force for a while. Thereafter, as the cam 34V rotates clockwise sufficiently and decreases in radius, the biasing force of the torsion spring 39 gradually decreases. Accordingly, the arm 38 rotates about the pivot 38*a* counterclockwise in FIG. 12A. Eventually, a minimum radius portion N1 of the cam 34V comes into contact with the cam follower 38*b*. Note that the minimum radius portion N1 of the cam 34V refers to a portion with the smallest cam radius as illustrated in FIGS. 12A and 12B. The biasing force of the torsion spring 39 causes the cleaning roller 35 to contact the pressure roller 31.

When the cleaning roller 35 moves from the contact position to the separate position, the reverse operation is performed.

Even when the moving assembly 80 including the cam 34V described above is applied with an unexpected external force, the moving assembly 80 does not erroneously move the cleaning roller 35 from the separate position to the contact position provided that the cam 34V does not rotate until the cam follower 38*b* contacts an outside of the range of the maximum radius portion N2 of the cam 34V.

In addition, an angle range of the maximum radius portion N2 of the cam 34V is set to be sufficiently greater than the angle at which the driven gear 34*b* rotates when the fixing device 20 is removed from the image forming apparatus 1 as described above with reference to FIGS. 7A to 7C. Accordingly, the unfavorable situations described above do not arise when the fixing device 20 is removed from or installed in the image forming apparatus 1.

Note that, in the first variation illustrated in FIGS. 12A and 12B, the maximum radius portion N2 on the cam face 34*f* (i.e., outer circumferential surface) of the cam 34V is in a range of about 60 degrees or greater around the cam shaft 34*a*. As described above, the cam 34V has the maximum radius portion N2 to locate the cleaning roller 35 at the separate position. Specifically, in the first variation, the maximum radius portion N2 of the cam 34V is in a range of about 120 degrees around the cam shaft 34*a*.

The maximum radius portion N2 in the range of about 60 degrees or greater around the cam shaft 34*a* of the cam 34V sufficiently exhibits the advantages described above.

Figure 13:
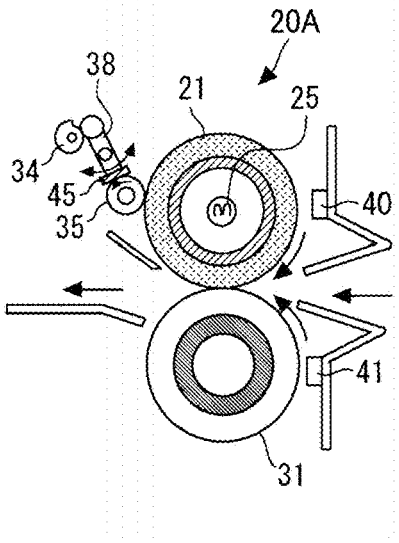
FIG. 13 is a cross-sectional view of a first variation of the fixing device.

Referring now to FIG. 13, a description is given of a first variation of the fixing device 20 described above.

FIG. 13 is a cross-sectional view of a fixing device 20A as the first variation of the fixing device 20 illustrated in FIG. 2.

In the fixing device 20A illustrated in FIG. 13, the cleaning roller 35 (i.e., cleaner) is configured to contact the surface of the fixing roller 21 (i.e., fixing rotator) to clean the surface of the fixing roller 21. That is, the fixing roller 21 is herein a cleaning target for the cleaning roller 35.

Like the fixing device 20 described above, the fixing device 20A includes the moving assembly 80 including the cam 34 or 34V.

With such a configuration, the fixing device 20A prevents the moving assembly 80 from failing to maintain the cleaning roller 35 apart from the fixing roller 21 and erroneously causing the cleaning roller 35 to contact the fixing roller 21.

Like the fixing device 20 described above, in the fixing device 20A, in a case in which the temperature of the cleaning roller 35 detected by the temperature sensor 45 (or the temperature of the fixing roller 21 detected by the temperature sensor 40) is greater than a given value A1, the cleaning roller 35 comes into contact with or apart from the fixing roller 21 during rotation of the fixing roller 21. By contrast, in a case in which the temperature detected by the temperature sensor 45 (or the temperature detected by the temperature sensor 40) is equal to or smaller than the given value A1, the cleaning roller 35 comes into contact with or apart from the fixing roller 21 during a stop of rotation of the fixing roller 21. In this case, the given value A1 (i.e., melting temperature) described above is a maximum temperature that does not cause an unfavorable situation in which extraneous matter (mainly toner), which has moved from the surface of the fixing roller 21 to the surface of the cleaning roller 35, returns to the surface of the fixing roller 21. In other words, the given value A1 is a maximum temperature that does not cause the extraneous matter to return from the surface of the cleaning roller 35 to the surface of the fixing roller 21 (i.e., cleaning target).

Such a configuration maintains an enhanced cleanability of the cleaning roller 35 while preventing the extraneous matter adhering to the surface of the cleaning roller 35 from returning to the surface of the fixing roller 21.

Figure 14A:
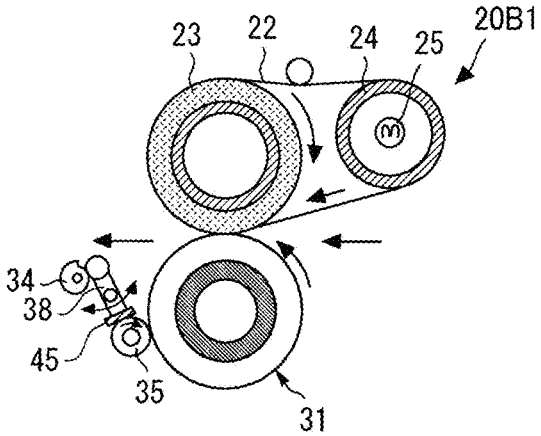
FIG. 14A is a cross-sectional view of a first example of a second variation of the fixing device.
Figure 14B:
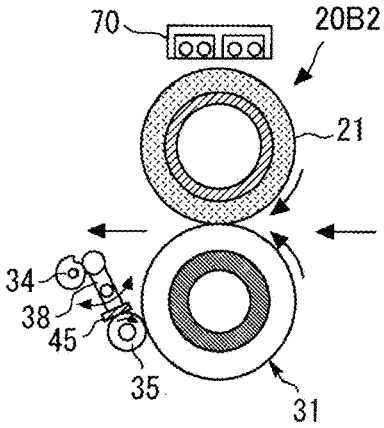
FIG. 14B is a cross-sectional view of a second example of the second variation of the fixing device.

Referring now to FIGS. 14A and 14B, a description is given of a second variation of the fixing device 20 described above.

FIG. 14A is a cross-sectional view of a fixing device 20B1 as a first example of the second variation of the fixing device 20 illustrated in FIG. 2. FIG. 14B is a cross-sectional view of a fixing device 20B2 as a second example of the second variation of the fixing device 20 illustrated in FIG. 2.

The fixing device 20 and the fixing device 20A described above are roller fixing devices employing a heating system. The fixing devices to which the embodiments of the present disclosure are applicable are not limited to such roller fixing devices. The embodiments are applicable to various types of fixing devices.

For example, the embodiments are applicable to the fixing device 20B1, which is a belt fixing device employing the heating system as illustrated in FIG. 14A. Specifically, the fixing device 20B1 includes a fixing belt 22 as a fixing rotator. In the fixing device 20B1, the fixing belt 22 is stretched and supported by a plurality of rollers such as an auxiliary fixing roller 23, a heating roller 24, and a tension roller. The auxiliary fixing roller 23 presses against the pressure roller 31 via the fixing belt 22, thereby forming a fixing nip between the fixing belt 22 and the pressure roller 31. The heater 25 is secured inside the heating roller 24 having a hollow structure.

The embodiments are also applicable to the fixing device 20B2, which is a roller fixing device employing an electromagnetic induction system or an induction heating (IH) system as illustrated in FIG. 14B. In the fixing device 20B2, the fixing roller 21 is constructed of, e.g., a core, an elastic layer resting on the core, a heat generation layer resting on the elastic layer, and a release layer resting on the heat generation layer. The heat generation layer is electromagnetically heated by an induction heater 70 that includes an exciting coil wound.

The embodiments are also applicable to a roller fixing device employing a resistive heat generation system. In such a fixing device, a fixing roller is constructed of, e.g., a hollow core, an elastic layer resting on the core, and a release layer resting on the elastic layer. A resistive heat generator is disposed to contact a hollow portion of the hollow core of the fixing roller.

Above-mentioned variations of the fixing device 20 provide substantially the same advantages as the advantages of the fixing device 20 described above.

As described above, the fixing device 20 of the present embodiment includes the moving assembly 80, constructed of the cam 34, the arm 38, and the torsion spring 39. The moving assembly 80 moves the cleaning roller 35 (i.e., cleaner) between the contact position at which the cleaning roller 35 contacts the surface of the pressure roller 31 (i.e., pressure rotator) and the separate position at which the cleaning roller 35 is apart from the surface of the pressure roller 31. The moving assembly 80 includes the torsion spring 39 (i.e., biasing member) that presses the cleaning roller 35 to move to the contact position. That is, the moving assembly 80 moves the cleaning roller 35 from the contact position to the separate position against the biasing force of the torsion spring 39. When the moving assembly 80 moves the cleaning roller 35 from the separate position to the contact position, the moving assembly 80 increases the biasing force of the torsion spring 39, which is greater than the biasing force applied when the cleaning roller 35 is located at the contact position, and then decreases the increased biasing force of the torsion spring 39.

Accordingly, the fixing device 20 prevents the moving assembly 80 from failing to maintain the cleaning roller 35 apart from the pressure roller 31 and erroneously causing the cleaning roller 35 to contact the pressure roller 31.

Note that, in the fixing devices described above, the pressure roller 31 is used as a pressure rotator. Alternatively, a pressure belt may be used as a pressure rotator.

The moving assembly 80 (i.e., cam assembly) constructed of, e.g., the cam 34 or 34V, the arm 38, and the torsion spring 39 is used to cause the cleaning roller 35 (i.e., cleaner) to come into contact and apart from the pressure roller 31 (or the fixing roller 21). However, the moving assembly 80 is not limited to the configuration described above. Alternatively, for example, the moving assembly 80 may include a solenoid.

The torsion spring 39 (or torsion coil spring) is used as a biasing member that presses the cleaning roller 35 (more specifically, the arm 38) toward the contact position. However, the biasing member is not limited to the torsion spring 39. Alternatively, for example, the biasing member may be a compression spring, a tension spring, or a flat spring.

In addition, a cooler may be disposed to contact the cleaning roller 35 (i.e., cleaner) at the separate position to cool down the cleaning roller 35 and prevent the cleaning roller 35 from easily reaching a high temperature.

Further, in the fixing devices described above, the cleaning roller 35 is used as a cleaner. However, the cleaner is not limited to the cleaning roller 35. Alternatively, for example, the cleaner may be a cleaning blade.

Such cases also provide substantially the same advantages as the advantages described above.

Note that the width direction is herein defined as a direction perpendicular to the sheet conveyance direction D.

The sheet P is herein defined as any sheet-like recording medium, such as general paper, coated paper, label paper, overhead projector (OHP) transparency, or a film sheet.

The series of fixing processes herein include processes of heating and fixing one or more toner images onto one or more sheets. In the series of fixing processes, the one or more toner images are heated and fixed onto the one or more sheets while the fixing device is continuously driven without stopping.

According to the embodiments of the present disclosure, an image forming apparatus includes a fixing device that prevents a moving assembly from failing to maintain a cleaner apart from one of a fixing rotator and a pressure rotator and erroneously causing the cleaner to contact the one of the fixing rotator and the pressure rotator.

Although the present disclosure makes reference to specific embodiments, it is to be noted that the present disclosure is not limited to the details of the embodiments described above. Thus, various modifications and enhancements are possible in light of the above teachings, without departing from the scope of the present disclosure. It is therefore to be understood that the present disclosure may be practiced otherwise than as specifically described herein. For example, elements and/or features of different embodiments may be combined with each other and/or substituted for each other within the scope of the present disclosure. The number of constituent elements and their locations, shapes, and so forth are not limited to any of the structure for performing the methodology illustrated in the drawings.

What is claimed is:

1. A fixing device comprising:

a fixing rotator configured to heat a toner image and fix the toner image onto a surface of a recording medium;

a pressure rotator configured to press against the fixing rotator to form a fixing nip through which the recording medium is conveyed between the fixing rotator and the pressure rotator;

a cleaner configured to contact and clean a surface of a cleaning target, the cleaning target including one of the fixing rotator and the pressure rotator; and a moving assembly configured to move the cleaner between a contact position at which the cleaner contacts the surface of the cleaning target and a separate position at which the cleaner is apart from the surface of the cleaning target, the moving assembly including, a biasing member configured to press the cleaner to move to the contact position, a cam follower, and an eccentric cam including a cam face configured to contact the cam follower as the eccentric cam rotates to move the cleaner from the contact position to the separate position against a biasing force of the biasing member while first to third portions of the cam face sequentially approach the cam follower as the cleaner moves from the contact position to the separate position, a radius of the second portion of the cam face being largest amongst the first to third portions such that the biasing force of the biasing member increases and then decreases as the cleaner moves from the contact position to the separate position.

2. The fixing device according to claim 1, wherein the moving assembly further includes: a cam shaft, the eccentric cam rotatable about the cam shaft, a pivot and an arm rotatable about the pivot, the arm configured to hold the cleaner, and to contact the eccentric cam, wherein the second portion of the cam face is a maximum radius portion and the third portion of the cam face is a large radius portion, wherein the large radius portion is in a range of 60 degrees or greater around the cam shaft, to locate the cleaner at the separate position, wherein the maximum radius portion is adjacent to the large radius portion and having a larger radius than the large radius portion; and wherein the biasing member is configured to press and rotate the arm to move the cleaner to the contact position.

3. The fixing device according to claim 1, wherein the moving assembly further includes a cam shaft, the eccentric cam rotatable about the cam shaft, a pivot, an arm rotatable about the pivot, and a driven gear rotatable together with the cam shaft, the arm configured to hold the cleaner, and to contact the eccentric cam, wherein the biasing member is configured to press and rotate the arm to move the cleaner to the contact position, wherein the moving assembly is configured to move the cleaner from the contact position to the separate position before the fixing device is removed from an image forming apparatus, and wherein the cleaner is configured to remain at the separate position when the driven gear meshing with a driving gear of the image forming apparatus rotates and comes apart from the driving gear in conjunction with removal of the fixing device from the image forming apparatus.

4. The fixing device according to claim 3, wherein the biasing member includes a torsion spring that includes an arm portion on a longitudinal end side of the torsion spring, wherein the arm portion is configured to be hooked on the arm, and wherein the arm includes the cam follower that is configured to contact the eccentric cam.

5. The fixing device according to claim 1, wherein the moving assembly further includes a cam shaft, the eccentric cam rotatable about the cam shaft, a pivot, and an arm rotatable about the pivot, the arm configured to hold the cleaner, and to contact the eccentric cam, wherein the biasing member is configured to press and rotate the arm to move the cleaner to the contact position, wherein the pivot is located between a contact part at which the arm contacts the eccentric cam and a point of effort at which the biasing member presses the arm, and wherein a relation of $A/B \leq 1.5$ is satisfied, where A represents a distance between the contact part and the pivot and B represents a distance between the point of effort and the pivot.

6. The fixing device according to claim 1, further comprising:

a temperature detector configured to detect a temperature of one of the cleaner and the cleaning target, wherein the moving assembly is configured to move the cleaner from the contact position to the separate position or from the separate position to the contact position during rotation of the cleaning target, in a case in which the temperature detected by the temperature detector is greater than a given value, and wherein the moving assembly is configured to move the cleaner from the contact position to the separate position or from the separate position to the contact position during a stop of rotation of the cleaning target, in a case in which the temperature detected by the temperature detector is equal to or smaller than the given value.

7. The fixing device according to claim 1, wherein the cleaner includes a cleaning roller that is configured to rotate together with the cleaning target when the cleaner is in contact with the cleaning target rotating in a given direction.

8. An image forming apparatus comprising:

an image bearer configured to bear a toner image; and the fixing device according to claim 1, the fixing device being configured to fix the toner image onto the surface of the recording medium.

9. A fixing device comprising:

a fixing rotator configured to heat a toner image and fix the toner image onto a surface of a recording medium;

a pressure rotator configured to press against the fixing rotator to form a fixing nip through which the recording medium is conveyed between the fixing rotator and the pressure rotator;

a cleaner configured to contact and clean a surface of a cleaning target, the cleaning target including one of the fixing rotator and the pressure rotator; and a moving assembly configured to move the cleaner between a contact position at which the cleaner contacts the surface of the cleaning target and a separate position at which the cleaner is apart from the surface of the cleaning target, the moving assembly including, a biasing member configured to press the cleaner to move to the contact position, a cam follower, and an eccentric cam including a cam face configured to contact the cam follower as the eccentric cam rotates to move the cleaner from the contact position to the separate position against a biasing force of the biasing member while first to third portions of the cam face sequentially approach the cam follower as the cleaner moves from the contact position to the separate position, a radius of the second portion of the cam face being largest amongst the first to third portions such that the biasing force of the biasing member increases and then is maintained at a force greater than the biasing force applied when the cleaner is located at the contact position and then decreases as the cleaner moves from the contact position to the separate position.

10. The fixing device according to claim 9, wherein the moving assembly further includes: a cam shaft, the eccentric cam rotatable about the cam shaft, a pivot and an arm rotatable about the pivot, the arm configured to hold the cleaner and to contact the eccentric cam, wherein the biasing member is configured to press and rotate the arm to move the cleaner to the contact position, and wherein the third portion of the cam face is a large radius portion in a range of 60 degrees or greater around the cam shaft, to locate the cleaner at the separate position.

11. An image forming apparatus comprising:

an image bearer configured to bear a toner image; and the fixing device according to claim 9, the fixing device being configured to fix the toner image onto the surface of the recording medium.

12. The fixing device according to claim 1, wherein the second portion of the cam face is a maximum radius portion and the third portion of the cam face is a large radius portion, and the maximum radius portion is adjacent to the large radius portion and has a larger radius than the large radius portion.

13. The fixing device according to claim 12, wherein the first portion of the cam face is a minimum radius portion, and when the cleaner is moved from the contact position to the separate position, the minimum radius portion, the maximum radius portion, and the large radius portion sequentially approach the cam follower.

14. The fixing device according to claim 13, wherein when the cleaner is moved from the separate position to the contact position, the large radius portion, the maximum radius portion, and the minimum radius portion of the cam face and sequentially approach the cam follower.

15. The fixing device according to claim 1, wherein the moving assembly is configured to move the cleaner from the contact position to the separate position before the fixing device is removed from an image forming apparatus, and the cleaner is configured to remain at the separate position when a driven gear of the moving assembly rotates and comes apart from a driving gear of the image forming apparatus in conjunction with removal of the fixing device from the image forming apparatus.

16. The fixing device according to claim 9, wherein the second portion of the cam face is a maximum radius portion and the third portion of the cam face is a large radius portion, and the maximum radius portion is adjacent to the large radius portion and has a larger radius than the large radius portion.

17. The fixing device according to claim 16, wherein the first portion of the cam face is a minimum radius portion, and when the cleaner is moved from the contact position to the separate position, the minimum radius portion, the maximum radius portion, and the large radius portion sequentially approach the cam follower such that, when the minimum radius portion of the cam face contacts the cam follower, the eccentric cam is separated from the cam follower.

18. The fixing device according to claim 17, wherein when the cleaner is moved from the separate position to the contact position, the large radius portion, the maximum radius portion, and the minimum radius portion of the cam face and sequentially approach the cam follower.

19. The fixing device according to claim 9, wherein the moving assembly is configured to move the cleaner from the contact position to the separate position before the fixing device is removed from an image forming apparatus, and the cleaner is configured to remain at the separate position when a driven gear of the moving assembly rotates and comes apart from a driving gear of the image forming apparatus in conjunction with removal of the fixing device from the image forming apparatus.

* * * * *